US009248501B1

(12) United States Patent
Johannes et al.

(10) Patent No.: US 9,248,501 B1
(45) Date of Patent: Feb. 2, 2016

(54) METHOD FOR ADDITIVE MANUFACTURING USING PH AND POTENTIAL CONTROLLED POWDER SOLIDIFICATION

(71) Applicants: Andrew C. Johannes, Pebble Beach, CA (US); Sebastian Osswald, Monterey, CA (US); Luke N. Brewer, Pacific Grove, CA (US)

(72) Inventors: Andrew C. Johannes, Pebble Beach, CA (US); Sebastian Osswald, Monterey, CA (US); Luke N. Brewer, Pacific Grove, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 359 days.

(21) Appl. No.: 14/041,852

(22) Filed: Sep. 30, 2013

Related U.S. Application Data

(60) Provisional application No. 61/722,623, filed on Nov. 5, 2012.

(51) Int. Cl.

| | |
|---|---|
| ***B22F 1/00*** | (2006.01) |
| ***B22F 3/03*** | (2006.01) |
| ***B22F 3/02*** | (2006.01) |
| ***B22F 3/12*** | (2006.01) |

(52) U.S. Cl.
CPC .... *B22F 3/02* (2013.01); *B22F 3/12* (2013.01)

(58) Field of Classification Search
CPC ..... B22F 3/03; B22F 1/0088; B22F 1/0096; B22F 2998/10; B22F 2999/00
USPC ..... 419/1, 38, 62, 66; 425/78
See application file for complete search history.

(56) References Cited

U.S. PATENT DOCUMENTS

| | | | | |
|---|---|---|---|---|
| 6,596,224 | B1 * | 7/2003 | Sachs | B22F 3/008 425/78 |
| 2009/0202904 | A1 * | 8/2009 | Geng | C01G 51/04 429/206 |
| 2015/0080495 | A1 * | 3/2015 | Heikkila | B22F 1/0059 523/223 |
| 2015/0135897 | A1 * | 5/2015 | Sutcliffe | B22F 3/1055 75/249 |

OTHER PUBLICATIONS

Cannone, et al. "Comments on the evaluation of valve regulated lead-acid batteries (VRLA) under deep cycling regimes" 1998.
Kirchev, et al. "Carbon honeycomb grids for advanced lead-acid batteries. Part I: Proof of concept" J. Power Sources 196, 2011, pp. 8773-8788.
Flagan, R. C. "Dynamics of pyrogenous fumes" Fuel Process. Technol. 39, 1994, pp. 319-336.
Andal, et al. "Synthesis of nano CuO by polymeric precursor method and its low temperature reduction to stable copper nanoparticles" J. Nano Res. 15, 2011, pp. 11-20.
(Continued)

*Primary Examiner* — Helene Klemanski
(74) *Attorney, Agent, or Firm* — Naval Postgraduate School; Lisa A. Norris

(57) ABSTRACT

A powder consolidation method and apparatus make use of corrosion processes occurring on surfaces of metal particles to consolidate a metal-containing powder into a formed body. The method includes contacting metal particles with an acidic or basic liquid at a pH and potential at which dissolution of metal from the particles and reduction of soluble metal-containing ions to metal on surfaces of the particles can co-occur, such that the metal powder agglomerates to form a body.

20 Claims, 18 Drawing Sheets

(56) References Cited

OTHER PUBLICATIONS

Danel, et al. "Study of Pb(II) in various H2O-H2SO4 mixtures by differential pulse polarography: Solubility of lead sulfate, diffusion-coefficient of Pb(II) and half-wave potential of Pb(Hg)/Pb(II)" Electrochim. Acta 27, 1982, pp. 771-774.
Foller, P. C. "Improved slurry zinc/air systems as batteries for urban vehicle propulsion" J. Appl. Electrochem. 16, 1986, pp. 527-543.
De Yoreo, et al. "Principles of crystal nucleation and growth" Reviews in mineralogy and geochemistry 54, 2003, pp. 57-93.
Loyalka, S.K. "Brownian coagulation of aerosols" Journal of Colloid and Interface Science 57, 1976, pp. 578-579.
Arora, et al. "Battery separators" Chemical Reviews 104, 2004, pp. 64.
Lyklema, et al. "DLVO-theory, a dynamic re-interpretation" Adv. Colloid Interface Sci. 83, 1999, pp. 33-69.
Bullock, K. R. "Lead-acid batteries" J. Power Sources 51, 1994, pp. 1-17.
Pavlov, et al. "Influence of H2SO4 concentration on the mechanism of the processes and on the electrochemical activity of the Pb/PbO2/PbSO4 electrode" J. Power Sources 137, 2004, pp. 288-308.
Marsalek, et al. "The reduction of zinc using goethite process and adsorption of Pb+2, Cu+2 and Cr+3 on selected precipitate" International Journal of Environmental Science and Development 2, 2011, pp. 255-258.
Karunakaran, et al. "Rapid manufacturing of metallic objects" Rapid Prototyping J. 18, 2012, pp. 264-280.
Chen, et al. "Hamaker-constant calculations and surface melting of metals, semimetals and semiconductors" Nuovo Cimento Della Societa Italiana Di Fisica D-Condensed Matter Atomic Molecular and Chemical Physics Fluids Plasmas Biophysics 13, 1991, pp. 919-937.
Sze, et al. "Zeta-potential measurement using the Smoluchowski equation and the slope of the current-time relationship in electroosmotic flow" Journal of Colloid and Interface Science 261, 2003, pp. 402-410.
Muste, et al. "Two-phase flow insights into open-channel flows with suspended particles of different densities" Environmental Fluid Mechanics 9, 2009, pp. 161-186.
Sharma, et al. "Spark plasma sintering of nanocrystalline Cu and Cu-10 wt pct Pb alloy" Metall. Mater. Trans. A-Phys. Metall. Mater. Sci. 42A, 2011, 2072-2084.
Perez-Maqueda, et al. "Effect of sonication on particle-size distribution in natural muscovite and biotite" Clays and Clay Minerals 51, 2003, 701-708.
Melchoir, et al. "Solar-driven biochar gasification in a particle-flow reactor" Chem. Eng. Process. 48, 2009, pp. 1279-1287.
McFadyen, et al. "High-resolution particle-size analysis from nanometers to microns" Clay Minerals 28, 1993, pp. 531-537.
Paul, et al. "Issues in fabricating manufacturing tooling using powder-based additive freeform fabrication" Journal of Materials Processing Technology 61, 1996, pp. 168-172.
Farmer, et al. "Effect of Rhodamine-B on the Electrodeposition of Lead on Copper" Journal of the Electrochemical Society 132, 1985, pp. 313-319.
Zhao, et al. "A novel sintering-dissolution process for manufacturing Al foams" Scripta Materialia 44, 2001, pp. 105-110.
Barg, et al. "Novel open cell aluminum foams and their use as reactive support for zeolite crystallization" Journal of Porous Materials 18, 2011, pp. 89-98.
Rat'Ko, et al. "Hydrothermal synthesis of porous Al2O3/Al metal ceramics: II. Mechanism of formation of a porous Al (OH)(3)/Al composite" Kinetics and Catalysis 45, 2004, pp. 149-155.
Barkey, et al. "Kinetic anisotropy and dendritic growth in electrochemical deposition" Phys. Rev. Lett. 75, 1995, pp. 2980-2983.
Shchekin, et al. "Generalization of the Gibbs-Kelvin-Kohler and Ostwald-Freundlich equations for a liquid film on a soluble nanoparticle" The Journal of Chemical Physics 129, 2008, pp. 154116-154115.
Ordal, et al. "Optical properties of 14 metals in the infrared and far infrared-Al, Co, Cu, Au, Fe, Pb, Mo, Ni, Pd, Pt, Ag, Ti, V and W" Appl. Optics 24, 1985, pp. 4493-4499.
Ruetshi, et al. "Self-discharge reactions in lead-acid batteries" Journal of the Electrochemical Society 105, 1958, pp. 555-563.
Vanberkum, et al. "Diffraction-line broadening due to strain fields in materials; Fundamental aspects and methods of analysis" Acta Crystallographica Section A 52, 1996, pp. 730-747.
Woo, et al. "Synthesis of nanodiamond-reinforced aluminum metal composite powders and coatings using high-energy ball milling and cold spray" Carbon 63, 2013, pp. 404-415.
Ilic, et al. "Viscosity of concentrated suspensions of spheres" Rheologica Acta 33, 1994, pp. 283-291.
Mirza. et al., "Sedimentation of suspensions of particles of two or more sizes" Chemical Engineering Science 34, 1979, pp. 447-454.
Park, et al. "Comparison of the Nernst-Planck model and the Poisson-Boltzmann model for electroosmotic flows in microchannels" Journal of Colloid and Interface Science 315, 2007, pp. 731-739.
Xie, et al. "Effects of dispersants and soluble counter-ions on aqueous dispersibility of nano-sized zirconia powder" Ceramics International 30, 2004, pp. 219-224.
Duduta, et al. "Semi-solid lithium rechargeable flow battery" Advanced Energy Materials 1, 2011, pp. 511-516.
Ho, et al. "Modelling of micro-particle agglomeration in turbulent flows" Chemical Engineering Science 57, 2002, pp. 3073-3084.
Blum, J. "Grain growth and coagulation" Astrophysics of Dust, ASP Conference Series 309, 2003, pp. 24.
Segets, et al. "Experimental and Theoretical Studies of the Colloidal Stability of Nanoparticles—A General Interpretation Based on Stability Maps" ACS Nano 5, 2011, pp. 4658-4669.
Kang, et al. "Fluctuation Effects in Smoluchowski Reaction-Kinetics" Physical Review A 30, 1984, pp. 2833-2836.
Heine, et al. "High concentration agglomerate dynamics at high temperatures" Langmuir 22, 2006, pp. 10238-10245.
Wattis, et al. "Exact solutions for cluster-growth kinetics with evolving size and shape profiles" J. Phys. A-Math. Gen. 39, 2006., pp. 7283-7298.
Kim, et al. "Improved orthokinetic coagulation model for fractal colloids: Aggregation and breakup" Chemical Engineering Science 61, 2006, pp. 45-53.
Pavlov, et al. "Premature capacity loss (PCL) of the positive lead-acid-battery plate—a new concept to describe the phenomenon" J. Power Sources 42, 1993, pp. 345-363.
Pourbaix. "Atlas of Electrochemical Equilibria in Aqueous Solutions" J. A. Franklin Trans., Second English Edition ed.,National Association of Corrosion Engineers, 1974, p. 479.
Scientific, H. in Horiba Instruments, Inc. vol. WP004 (Online: http://www.horiba.com/scientific/products/particle-characterization/download-center/white-papers/, 2012).

* cited by examiner

METHOD FOR ADDITIVE MANUFACTURING USING PH AND POTENTIAL CONTROLLED POWDER SOLIDIFICATION

This application claims the priority of U.S. Provisional Application Ser. No. 61/722,623, filed Nov. 5, 2012, entitled METHOD FOR ADDITIVE MANUFACTURING USING PH AND POTENTIAL CONTROLLED POWDER SOLIDIFICATION, the disclosure of which is incorporated herein by reference in its entirety.

BACKGROUND

The exemplary embodiment relates to the fabrication arts and finds particular application in connection with system and method for fabrication of solid bodies, such as electrodes, by powder consolidation.

Current manufacturing techniques for forming shaped bodies include subtractive shaping, formative shaping, and additive shaping. Subtractive shaping starts with a raw material and then successively subtracts pieces away to achieve the desired morphology and tends to produce large amounts of waste material. Examples of such techniques include grinding, drilling, and machining. Formative shaping applies pressure and often heat to the raw material, generally requiring high energy. Examples of such techniques include pressing, bending, casting, and forging. Additive shaping involves the successive addition of raw material to form a desired product. Three-dimensional (3-D) objects can thus be built from multiple layers of material.

Additive manufacturing offers several benefits over traditional manufacturing methods. These include lower production costs, increased design flexibility, and shorter product development times. Production costs can be reduced by lessening the amount of waste material generated by traditional machining processes, simplifying the production line by using fewer operations, and eliminating the additional investment in tooling and fixtures required for new products. This can be advantageous for small- to medium-scale productions of metal parts, especially in industries with short product life cycles and high innovation demands. However, conventional additive manufacturing techniques entail the use of high energy in the form of laser energy or heat. For example, laser aided additive manufacturing (LAAM) techniques have been developed which use laser energy as a heat source for melting a base substrate while simultaneously adding material in a layer-by-layer process. However, the LAAM process is subject to several limitations including a lack of control over phases and microstructures, potential defects, surface oxidation, and laser-based heat and energy requirements. (Melchior, T., et al., Solar-driven biochar gasification in a particle-flow reactor. *Chem. Eng. Process.* 48, 1279-1287 (2009); Cannone, A. G., et al., Comments on the evaluation of valve regulated lead-acid batteries (VRLA) under deep cycling regimes. *IEEE* 13$^{th}$ *Ann'l Battery Conf. on Applications and Advances*, 271-278 (1998)).

In the battery field, manufacturing of lead (Pb) electrodes traditionally involves high pressure injection of a molten lead alloy into casts, machining grooves into flat lead alloy plates, or crimping and rolling lead strips into rosettes that are inserted into holes in a casted plate. (Reddy, T. B. *Linden's Handbook of Batteries, Fourth Edition*. (McGraw-Hill 2011). More recently, carbon-based current collectors coated with electroplated Pb have been developed to increase the specific energy density. However, corrosion-induced degradation of the surface coating and stress-induced cracking of the carbon composite during cycling poses significant difficulties. (Kirchev, A., et al. Carbon honeycomb grids for advanced lead-acid batteries. Part I: Proof of concept. *J. Power Sources* 196, 8773-8788 (2011)). Powder consolidation processes, particularly in the manufacture of metal foams, generally involve high temperature sintering or melting. One sintering-dissolution process (SDP) for the production of Al metal foams involves mixing and compacting dry Al and NaCl powders in a mold. The mixture is then sintered far below the melting point of the NaCl and finally the NaCl is dissolved away using deionized water. (Zhao, Y. Y., et al. A novel sintering-dissolution process for manufacturing Al foams. *Scripta Materialia* 44, 105-110 (2001). A direct foaming process has also been proposed in which a thick slurry, containing a mixture of Al particles and surfactants to prevent agglomeration and stabilize the particles, is poured into molds, dried at atmospheric conditions for consolidation, and the heat treated above the melting point to achieve consolidation. (Barg, S., et al. Novel open cell aluminum foams and their use as reactive support for zeolite crystallization. *J. Porous Materials* 18, 89-98 (2011)). A hydrothermal bayerite synthesis method has also been developed that involves the growth and consolidation of Al particles by the formation of a porous layer of aluminum hydroxide. The hydroxide formation makes the particles grow in size and acts as a binder to hold the particles together when in contact. (Rat'ko, A. I., et al. Hydrothermal synthesis of porous $Al_2O_3$/Al metal ceramics: II. Mechanism of formation of a porous Al(OH)(3)/Al composite. *Kinetics and Catalysis* 45, 149-155 (2004)).

All of these methods tend to involve high energy/raw material costs or produce unstable products.

The exemplary embodiment provides a method for additive manufacturing which enables shaped bodies to be formed which overcomes the problems with existing methods.

BRIEF DESCRIPTION

In accordance with one aspect of the exemplary embodiment, a powder consolidation method includes contacting a metal-containing powder including metal particles with an acidic or basic liquid at a pH and in a potential range at which dissolution of metal from the particles and reduction of soluble metal-containing ions to reduced metal on surfaces of the particles occur such that the reduced metal on surfaces of the particles occur such that the metal particles are bound together by the reduced metal to form a body.

In accordance with another aspect of the exemplary embodiment, a powder consolidation apparatus includes a mold including a cavity which defines the shape of a shaped body. A source of a metal-containing powder supplies metal powder to the cavity, the metal-containing powder including metal particles. A source of acidic or basic aqueous liquid is fluidly connected with the cavity which provides acidic or basic liquid in the cavity, such that a pH and in a potential range during contact of the particles with the aqueous liquid allow dissolution of metal from the particles and reduction of soluble metal-containing ions to metal on surfaces of the particles to occur such that the metal particles agglomerate to form a shaped body in the mold cavity. Optionally, at least one of a controller for maintaining a temperature of the liquid in the cavity at less than 100° C. and an agitator for agitating the metal particles in the cavity is also provided.

DETAILED DESCRIPTION

Figure 1:
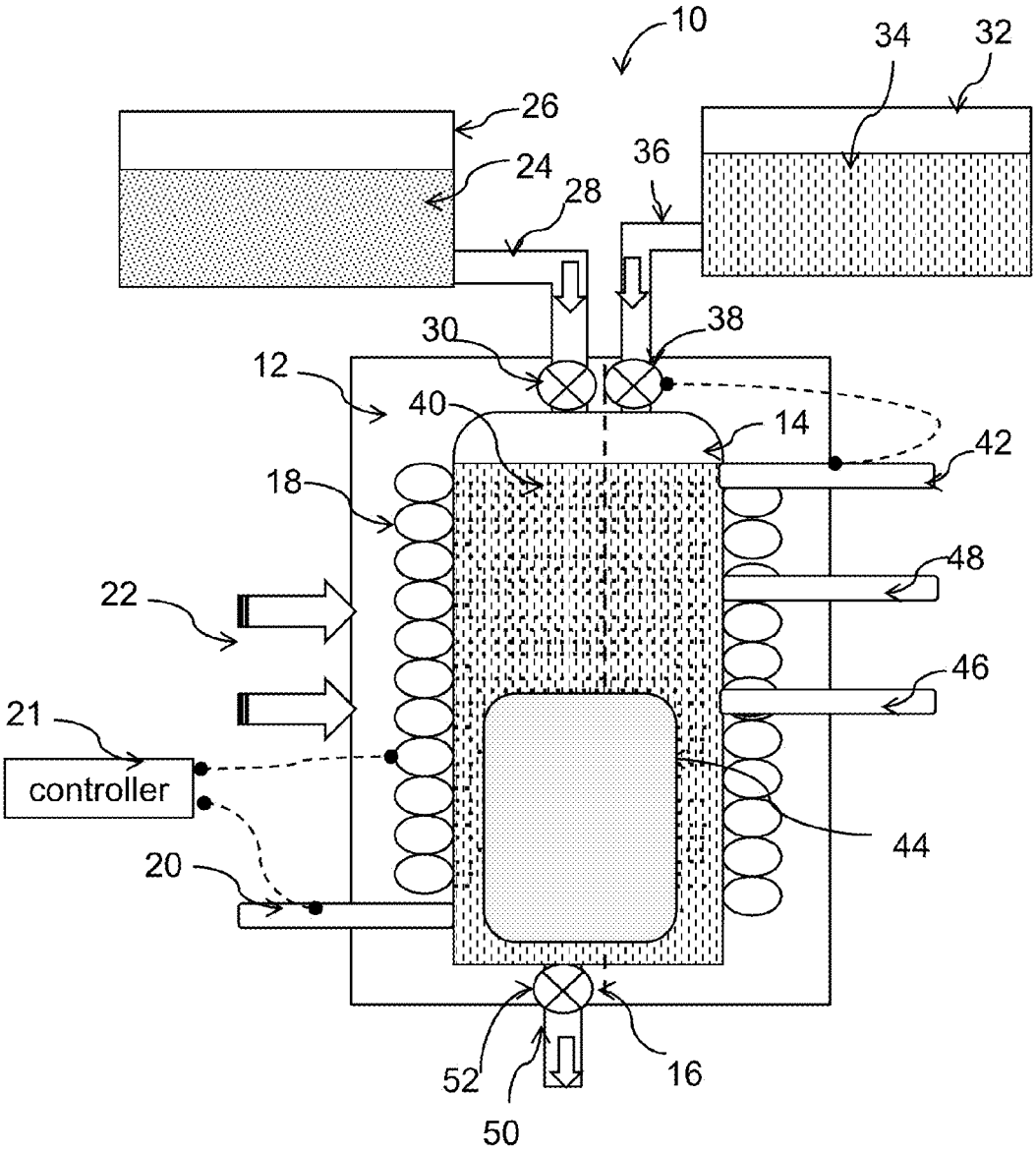
FIG. 1 a functional block diagram of an apparatus for additive manufacturing in accordance with one aspect of the exemplary embodiment.

Disclosed herein is an additive manufacturing process for forming shaped bodies which is referred to as chemically-driven powder consolidation (CDPC). In the exemplary method, the re-deposition process can be controlled so as to consolidate metal and non-metal powders, for additive manufacturing. In one embodiment, a multi-stage model is employed that serves as the basis for the development of a CDPC-driven additive manufacturing process. The feasibility of the method for bulk synthesis of metal and metal composite components from a base powder is also demonstrated.

In contrast to existing additive manufacturing approaches, the exemplary CDPC process can significantly reduce manufacturing costs by limiting the amount of energy used to achieve the desired material consolidation. While current additive manufacturing technologies are based on the localized sintering/melting of a material, the exemplary method utilizes naturally occurring internal electrochemical potentials to drive the consolidation. In contrast to SDP and direct foaming, for example, the CDPC process does not require high temperatures for consolidation, but can utilize naturally occurring chemical potentials to induce the re-deposition of the metal itself as the binder, instead of secondary phases such as metal hydroxide or other compounds.

The system complexity is lower as compared to laser-based systems, allowing for substantial reductions in equipment costs.

The exemplary method involves pH and electrochemical potential-controlled powder agglomeration, which can occur at or near International Organization of Standards (ISO) conditions (15° C., 1 atmosphere). For example, the forming of the shaped body by agglomeration can take place at a temperature of less than 30% of the melting point (in ° C.) of the metal. For lead, the melting point is 328° C. The forming of the shaped body by agglomeration, for example, can occur at a temperature of no greater than 100° C., or up to 50° C., or up to 30° C. (e.g., when the metal is lead or a lead alloy), and may occur at a pressure of no greater than 200 Kpa (~2 atmospheres), e.g., up to 150 Kpa, or up to 120 Kpa or approximately 100 Kpa. This addresses the issue of the amount of energy (and hence cost) for additive manufacturing by avoiding the need to employ large amounts of energy for the process.

The CDPC-driven additive manufacturing technology is illustrated using the example of lead (Pb). It is to be appreciated, however, that the method is also applicable to forming shaped bodies of a variety of metals, metalloids and their alloys, such lead, tin, copper, cobalt, molybdenum, bismuth, silicon, indium, thallium, tellurium, zinc, and mixtures thereof. For convenience, metalloids such as silicon, germanium, antimony, and tellurium, are considered as metals in the following description and claims.

The exemplary forming method can be employed, for example, for manufacturing lead or lead alloy electrodes for use in lead-acid batteries, and the like, and in particular, rechargeable batteries. Batteries employing electrodes formed by the exemplary methods may find use in automotive, industrial, and telecommunications industries. CDPC thus provides an alternative method for electrode manufacture which avoids the challenges arising during machining and conventional electroplating, while also lowering manufacturing costs and improving electrode performance.

In the exemplary method, lead (and/or other metal) powders agglomerate into larger, dense aggregates when immersed in an acidic or alkaline solution, with or without an applied voltage potential, at or near ISO conditions. The rate at which agglomeration occurs is dependent, at least in part, on the pH and the temperature of the "solution" (i.e., the liquid and particle dispersion). The simultaneous dissolution of the solid lead to lead ions and their redeposition on the surface of the powder particles result in the agglomeration of the lead powder into a solid metal body. Agitation mechanisms can be used to decrease the agglomeration time and increase the rate of the densification process. These mechanisms include sonic agitation, stirring, shaking, and other mechanisms that cause the metal particles and pieces to vibrate in the solution and/or increase the solution temperature.

FIG. 1 illustrates an exemplary apparatus 10 for forming a shaped body which can be used in the exemplary method. The apparatus includes a mold 12 which defines an internal cavity 14 in the desired shape of a formed body. The mold may be a two-part or multi-part mold, illustrated in the exemplary embodiment by the dotted line 16. One or more heating elements 18 surround the cavity 14. The internal temperature of the cavity may be monitored by a suitably positioned temperature probe 20 and used as feedback by a temperature controller 21 to control the heating elements. Optionally, an agitation device 22, such as a sonic agitator, agitates the contents of the cavity. The cavity 14 is fed with a metal-containing powder 24, which includes solid metal particles, or with a liquid suspension of the particles, e.g., an aqueous suspension. The metal-containing powder/suspension may be supplied from a vessel 26, such as a hopper, which is connected with the cavity by a pipe 28, or the like. A valve 30 selectively releases the powder/suspension into the cavity. A vessel 32 containing an acidic or alkaline solution (pH adjusting solution) 34 is also fluidly connected with the cavity via a pipe 36, or the like. A valve 38 selectively releases the pH adjusting solution 34 into the cavity. The pH of the particle-containing liquid ("solution") in the cavity may be monitored by a suitably positioned pH monitoring device 42, which may be used as feedback to control the release of pH adjusting solution 34 into the cavity to maintain a desired pH. The pH adjusting solution 34, or a separate liquid, may include one or more additives, such as surfactants, to be introduced into the cavity. Alternatively or additionally, the additives may be combined with the metal particles 24.

In the illustrated embodiment, the heated cavity 14 is at least partially filled with the powder/suspension 24 and the pH adjusted with the pH adjusting solution 34 to form solution 40. Alternatively, the pH adjusting solution 34 is introduced to the cavity before the powder/suspension 24. The agitation device 22 agitates the mixture, and the particles begin to aggregate to form a solid body 44 which is predominantly lead. The potential can also be adjusted, for example, by an external voltage applicator 46 and/or by addition of one or more potential adjusting chemicals to the solution 40. An oxygen probe 48 may be used to detect the concentration of dissolved oxygen in the liquid 40 or 34 and optionally used as feedback to control the level of dissolved oxygen in the added liquid 34, for example, by using an air/oxygen or inert gas bubbler, and/or a vacuum pump, fluidly connected with the mold cavity 14 and/or vessel 32.

The excess liquid can be released from the cavity via an outlet pipe 50, which is selectively closed by a valve 52. The addition of particulate suspension 24 and/or pH adjusting solution 34 can be repeated one or more times to build up a shaped body having a shape substantially corresponding to that of the cavity, e.g., the shape of an electrode. As will be appreciated, once a sizeable body has been built up, further layers can be added using a different particulate suspension 24, e.g., containing a different metal, or using different pH, temperature etc. conditions to change the morphology of the outer layer(s) of the formed body, e.g., in terms of particle size of the particles forming the layer. Once a formed body of the desired shape has been achieved, the mold 12 can be opened or broken and the shaped body released from the cavity. Further processing of the shaped body can be performed, depending on its end use, such as further shaping, sintering, polishing, coating, or the like.

Figure 2:
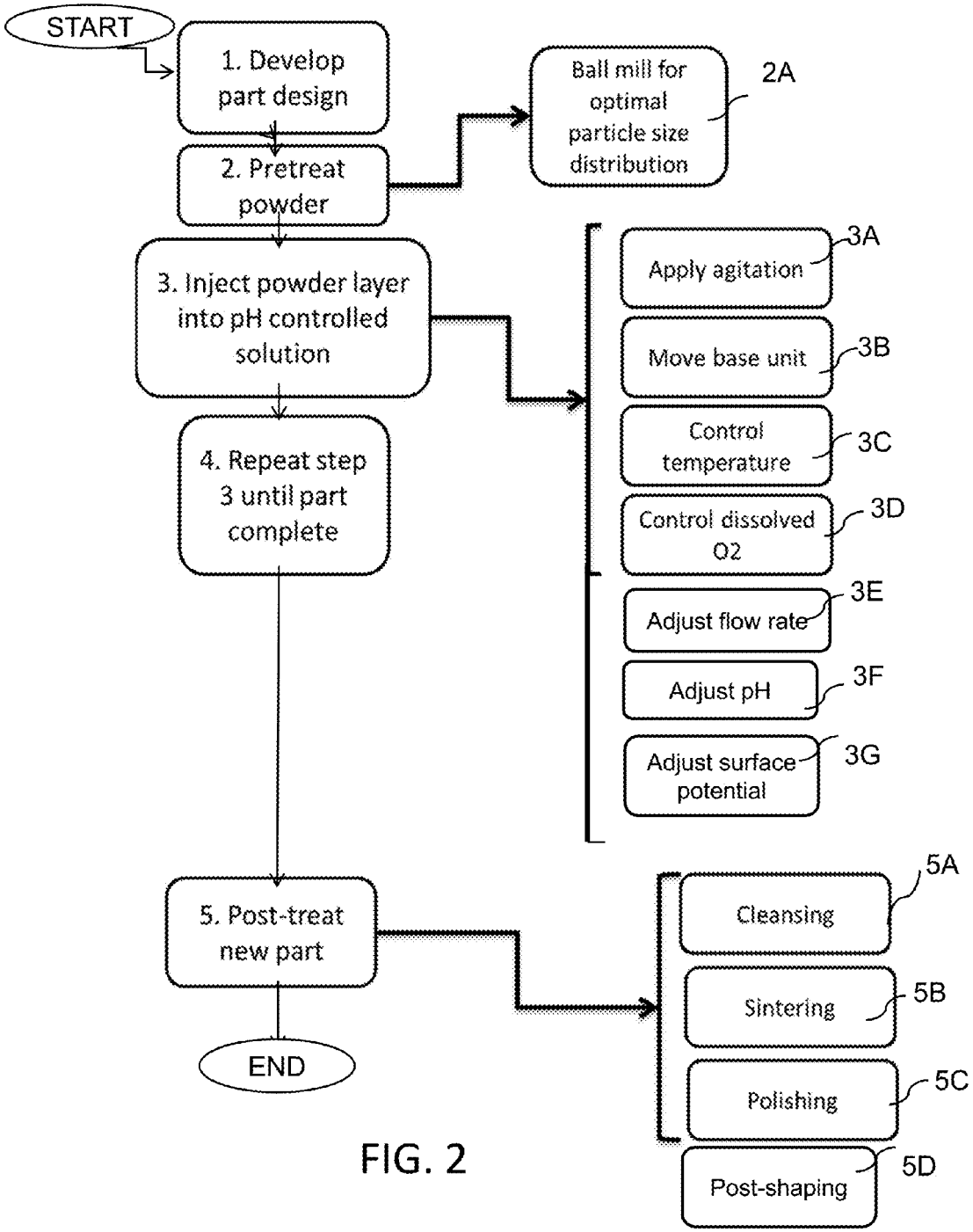
FIG. 2 is a flow chart illustrating a method for additive manufacturing in accordance with another aspect of the exemplary embodiment.

As will be appreciated, the exemplary method is not limited to the apparatus illustrated in FIG. 2, but may be varied depending on the shape, size, or end use of the shaped body.

The exemplary method can be applied to additive manufacturing by immersing a lead powder in an aqueous solution at a controlled pH in order to aggregate and densify metal powders. This process allows for the low cost fabrication of solid metal with the morphology desired for the end use of the shaped body.

FIG. 2 is a flow chart illustrating an exemplary method for forming a shaped body which may include the following five steps: 1: part design and fabrication; 2: powder preparation; 3 and 4: additive formation of the shaped body; and 5: post-treatment. As will be appreciated, one or more of the steps of the process may be omitted and/or additional steps included.

Step 1

A new part may be designed and a suitably shaped mold may be configured for forming the part or a portion thereof.

Step 2

In this step, a powder precursor, such as metal powder, to be used in forming the part may be pretreated, for example, by milling (mechanical alloying), such as ball milling, and/or sieving to provide a desired particle size distribution (2A). In general, the smaller the particle size, the less mechanical agitation is required and the faster the agglomeration. Therefore, the particle size of the precursor powder can be used to control the solidification process.

As with any manufacturing process, being able to control the system and the outputs is advantageous. Being a powder consolidation technique, CDPC densifies a material by binding agglomerated powder particles together via re-deposition of dissolved ions. In most cases, the composition and crystallinity of the precursor powder largely determine the structural characteristics of the consolidated material at the sub-micron and low micrometer scale. In some embodiments, a complete dissolution and re-deposition of the precursor powder 24 may be achieved, for example by using secondary compounds as nucleation sites (e.g., carbon nanotubes).

The particle size of the metal powder precursor 24 can be controlled by powder grinding methods, such as high energy ball milling and/or cryogenic milling. In some cases, the as-received powder may be sufficiently finely divided that further size reduction is not needed.

By way of example, the average particle size (mean particle diameter) of the metal particles in the metal-containing powder following the grinding or other pretreatment process (if any), may be less than 200 μm (microns), e.g., less than 100 μm, or less than 80 μm, or less than 50 μm, or less than 30 μm and may be at least 0.2 μm or at least 1 μm, as determined by dynamic light scattering according to the Horiba Instruments Scientific White paper WP004, entitled Sampling for Particle Size Analysis (Online: http://www.horiba.com/scientific/products/particle-characterization/download-center/white-papers/, 2012). Additionally, the particles desirably have a particle size distribution which can be mono, bi- or multi-modal. For example, at least 10% of the particles are greater than/less than ±50% of the median particle size.

In terms of US mesh size, the optionally pretreated metal particles may be at least 200 mesh (up to ~75 μm particles), or at least 300 mesh (up to ~53 μm particles), or at least 325 mesh (up to ~44 μm particles), or at least 400 mesh (up to ~37 μm particles). The US mesh size is the number of openings per linear inch of mesh (through which the particles are able to pass). Larger mesh sizes thus mean smaller particles.

In some embodiments, the metal-containing powder (and formed body) may be predominantly (over 50 wt. %) metal, such as at least 60 wt. %, or at least 80 wt. %, or at least 90 wt.

%, and in some embodiments up to 99 wt. % or 99.999 wt. %, metal, or higher. Additionally, the metal present may be predominantly in the metal phase, rather than in an oxidized or reduced form, i.e., over 50 wt. % of the metal in the powder and/or the formed body are in the metal phase, such as at least 60 wt. %, or at least 80 wt. %, or at least 90 wt. %, and in some embodiments up to 99 wt. % or 99.999 wt. %. In one embodiment, the particles are free of an oxide layer, although in some embodiments the oxide is removed in the forming stage.

In some embodiments, secondary materials may be incorporated into the metal-containing powder. Utilization of nanopowders may enable a rapid solidification process and fabrication of highly dense solids. Secondary materials, such as carbon nanotubes (e.g., nanotubes with an average length of less than 1000 nm or less than 100 nm in their longest dimension, and optionally where at least 90% of the nanotubes are less than 100 nm or 200 nm in their longest dimension) may be combined and optionally ground with the metal powder. This may enable larger aggregates to form in steps 3 and 4.

Where such secondary materials are introduced in to the powder, the metal content of the powder may be lower, and in some cases, less than 50 wt. % metal, such as at least 10 wt. % metal, or at least 20 wt. % metal.

Step 3

In step 3, the (optionally pretreated) metal-containing powder is introduced to a pH controlled solution, e.g., in the mold or other forming vessel, and the particles allowed to agglomerate to form a larger body. This step may include one or more substeps selected from dispersion of the particles, e.g., by agitation of the liquid (3A), moving of the base unit on which the mold is supported (3B), control of the temperature (3C), control of dissolved oxygen (3D), adjusting the flow rate of particles (3E), adjusting the pH (3F), and adjusting the surface potential (3G). In the solution, the ions are maintained in excess, such that the solution is supersaturated and deposition of solid metal is favored.

Various agitation mechanisms (3A) can be used to reduce the agglomeration time and increase the production capability. These mechanisms include sonic/ultrasound agitation, mechanical stirring, shaking, and other mechanisms that cause the metal particles and pieces to vibrate in the solution. The agitation improves mass transport and may increase the temperature, both of which can increase the reaction rates. Unexpectedly, it has been observed that the agglomeration process intensifies during sonication, a process that is commonly used to break up agglomerates in suspensions, suggesting a complex consolidation mechanism.

The base unit supporting the mold can be moved (3B) to change the orientation of the cavity and build up a somewhat different shape.

The temperature of the solution can be controlled (3C) using an external heat source 18, such as a heating mantle, hot plate, and/or heating tape. The temperature can be maintained at less than 100° C., such as less than 50° C., or less than 40° C., and in one embodiment, at least 10° C., or at least 20° C. In other embodiments, the liquid is added at a desired temperature. In some embodiments, no heating is needed.

In some embodiments, the pressure within the mold cavity is maintained at a selected pressure. The maintained pressure can be atmospheric or lower or greater than 1 atm (~100 Kpa), such as up to 120 Kpa, or up to 150 Kpa, or up to 200 Kpa. In other embodiments, the pressure within the mold cavity or other forming vessel is allowed to stabilize at about atmospheric pressure.

Dissolved oxygen can be controlled (3D) by adding/removing oxygen from the solution 40, e.g., with an oxygen/air bubbler, or by replacing at least some of the dissolved oxygen in the solution 40 or introduced liquid 34 with an inert gas, such as argon or nitrogen. In one embodiment, an oxygen concentration of the liquid is less than 50% of saturation (the % saturation defined as the measured dissolved oxygen divided by the maximum oxygen the liquid can hold at the contacting temperature). For example, at 25° C., the dissolved oxygen concentration in the contacting liquid may be about 4 ppm or less.

The rate at which particles are introduced (3E) can be used to change the morphology of the final product by introducing smaller particles which fill the voids between already agglomerated ones.

The pH of the solution can be controlled (3F) by adjusting the concentration of $H^+$ and $OH^-$ ions in the solution though the addition of acidic and/or alkaline substances and/or adjusting the rate at which they are added. As examples, inorganic acids such as sulfuric and nitric acids, or metal hydroxides, such as sodium and potassium hydroxides, may be used. The concentration of the acid (resp. alkali) may be at least 2M, or at least 4M, where the optimum operating region is low (resp. high) pH.

The surface potential is maintained (3G) in a range at which local differences in surface potential allow dissolution of metal to form ions and redeposition of ions to form metal to occur contemporaneously, once an initial amount of the metal has dissolved. The voltage potential can be kept in this range by at least one of a) the addition of potential-control agents, such as hydrogen peroxide and vanadium oxide, e.g., via line 36, and b) direct application of external voltage potential to the mold, e.g., via voltage applicator 46 which applies a field that changes the potential. Surfactants, such as Rhodamine B, may also be used to adjust surface potential and can influence the agglomeration rate of the powders in a given pH range in order, for example, to control the porosity/density of the solid to be produced.

In the exemplary embodiment, the method relies on the redox reactions which take place and does not rely on the application of any external source of power, such as an electric current, which is conventionally used in electrodeposition processes.

Step 4

One or more of the substeps performed at step 3 may be repeated one or more times until a shaped body is formed. The process of forming the shaped body (steps 3 and 4) may take from under 5 minutes up to 50 hours, or more, depending on the desired size and morphology of the shaped body and the conditions used. The shaped body may be at least 10 times or at least 100 times the average particle size of the original particles 24. For example, the resulting shaped body may be at least 0.1 cm (or at least 0.5 cm, or at least 1 cm, or at least 5 cm) in its longest dimension.

In some cases, the aggregates may not be constrained in their shape, e.g., by a mold, but are allowed to form naturally in the solution, e.g., as a plurality of bodies that are generally spherical in shape.

The resulting product may be at least 50 wt. %, or at least 80 wt. %, or at least 90 wt. % metal, and can be up to 99 or 100 wt. % metal. In the case where the metal powder is combined with a solid non-metallic material, such as carbon nanotubes, the resulting product may be at least 50 wt. %, or at least 80 wt. %, or at least 90 wt. % metal plus these other materials, and can be up to 99 or 100 wt. %. In some embodiments, the solid non-metallic materials, where present, contribute no more than 90 wt. %, or up to 70 wt. %, or up to 50 wt. % of the resulting shaped body/aggregates.

Step 5

At step 5 the shaped body may be post-treated. This step may include one or more substeps selected from cleaning (5A), sintering (5B), polishing (5C), further shaping (5D), and the like. Sintering takes place at a temperature below the melting point of the base metal(s) from which the formed body is formed. For example, a Pb aggregate may be sintered at a temperature of at least 120° C. or at least 130° C., or at least 140° C., such as less than 180° C., or less than 160° C., to improve its mechanical strength.

In the exemplary method, lead (Pb) powders agglomerate into larger aggregates as a function of pH and voltage potential when immersed in an aqueous solution at or near International Organization of Standards (ISO) conditions. This process can be applied to additive manufacturing by immersing a lead powder in an aqueous solution at a controlled pH and applying a voltage potential. The dissolution of the solid lead particles to ions occurs on the surface thereby agglomerating the lead powder into a solid body. The process can be controlled by varying the temperature, potential, and concentration of hydrogen ions (acidity) and hydroxide ions (alkalinity). Suitable conditions to be used can be determined from the Nernst Equation:

$$E = E^O - \frac{RT}{nF}\ln\frac{(C_R^{\nu_R})}{C_O^{\nu_O}} \tag{1}$$

where E is the open current potential, $E^O$ is the open current potential at steady state, R is the gas constant, T is absolute temperature in Kelvin (K), n is the number of electrons exchanged in the chemical reaction, F is Faraday's constant, $C_R^{\nu_R}$ is the concentration of the reduced species at the surface, and $C_O^{\nu_O}$ is the concentration of the oxidized species at the surface. For the reaction of the solid lead to plumbous ion ($Pb^{2+}$) in the acidic region, the Nernst equation becomes:

$$E = E^O_{Pb\to Pb^{2+}} - \frac{RT}{2F}\ln[Pb^{2+}] \tag{2}$$

This assumes a chemical activity of 1 for solids and liquids. For the reaction of solid lead to biplumbite ion ($HPbO_2$—) in the alkaline region, the Nernst equation becomes:

$$E = E^O_{Pb\to HPbO_2^-} - \frac{RT}{2F}\ln\{[HPbO_2^-][H^+]^3\} \tag{3}$$

For ease of determining suitable operating region for the manufacturing process, existing potential-pH equilibrium diagrams for the base element(s) can be used to identify an operating region in which both lead metal and metal ions are able to coexist. The regions where solid oxide films are formed should be avoided due to the surface being resistant to the dissolution of the metal.

Figure 3:
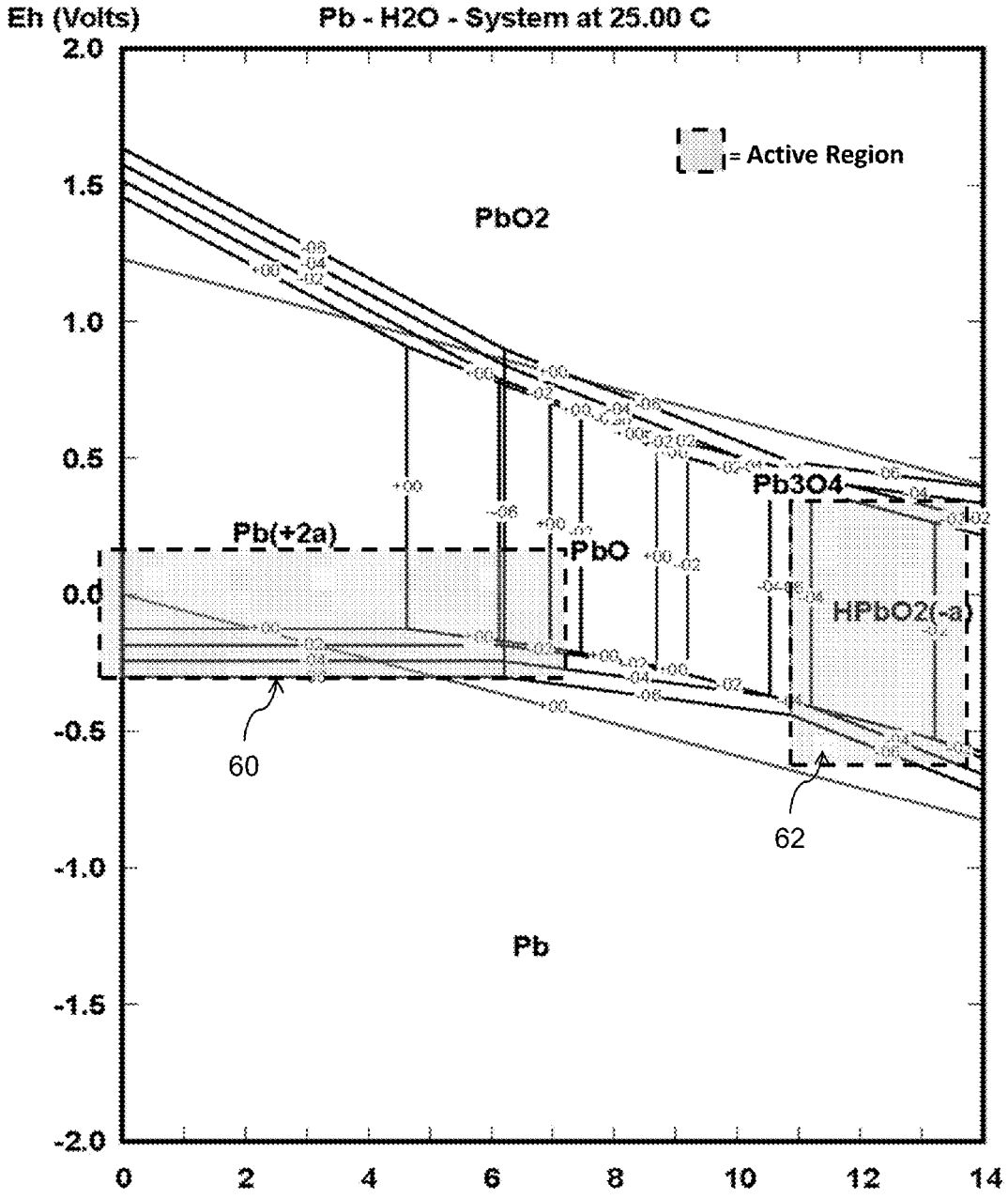
FIG. 3 is a potential-pH equilibrium diagram (Pourbaix Diagram) showing operating regions for the additive manufacturing method in the case of lead-water at 25° C.

By way of example, FIG. 3 shows the Potential-pH equilibrium diagram (Pourbaix diagram) with operating regions for lead in water at 25° C. The basic plot was obtained from Pourbaix, M. in *Atlas of Electrochemical Equilibria in Aqueous Solutions*, in Franklin J. A. (Ed.), Second English Edn (National Association of Corrosion Engineers, 1974, hereinafter, "Pourbaix 1974"). The plot has been adapted to show suitable active regions 60 and 62, which are acid and alkaline respectively, in which both lead metal and lead ions are able to coexist. In particular, a suitable operating region for use in acid conditions is from +0.1 E(V) to −0.3 E(V) and a pH from −2 to +6.5, or 0 to 6. A suitable operating region for use in alkaline conditions is from +0.3 E(V) to −0.7 E(V) and a pH from +14 to +16. It should be noted that local different concentrations of ions result in local potential changes such that at any time, one part of the surface of the particles may be operating in the region of the Pourbaix diagram (above line C) in which $Pb^{2+}$ is favored while another part of the surface is in the region where Pb is favored, such that deposition and dissolution can occur contemporaneously.

As will be appreciated, for different temperatures, different regions will be appropriate. For example, a three dimensional Pourbaix diagram can be generated or obtained which has temperature as a third dimension for identifying a suitable acid or alkaline region at a given temperature.

In the acidic region, for example, hydrogen ions and dissolved oxygen are typically the two main oxidizing agents. In the case of lead, the following oxidation/reduction reactions are believed to take place:

$$2Pb+O_{2(g)}+2H_2O_{(l)}\rightarrow 2Pb^{2+}+4OH^- \text{ (−1.06 V @ 20° C.)} \tag{4}$$

$$Pb+2H^+\rightarrow Pb^{2+}+H_{2(g)} \text{ (−0.12V @ 20° C.)} \tag{5}$$

Figure 4:
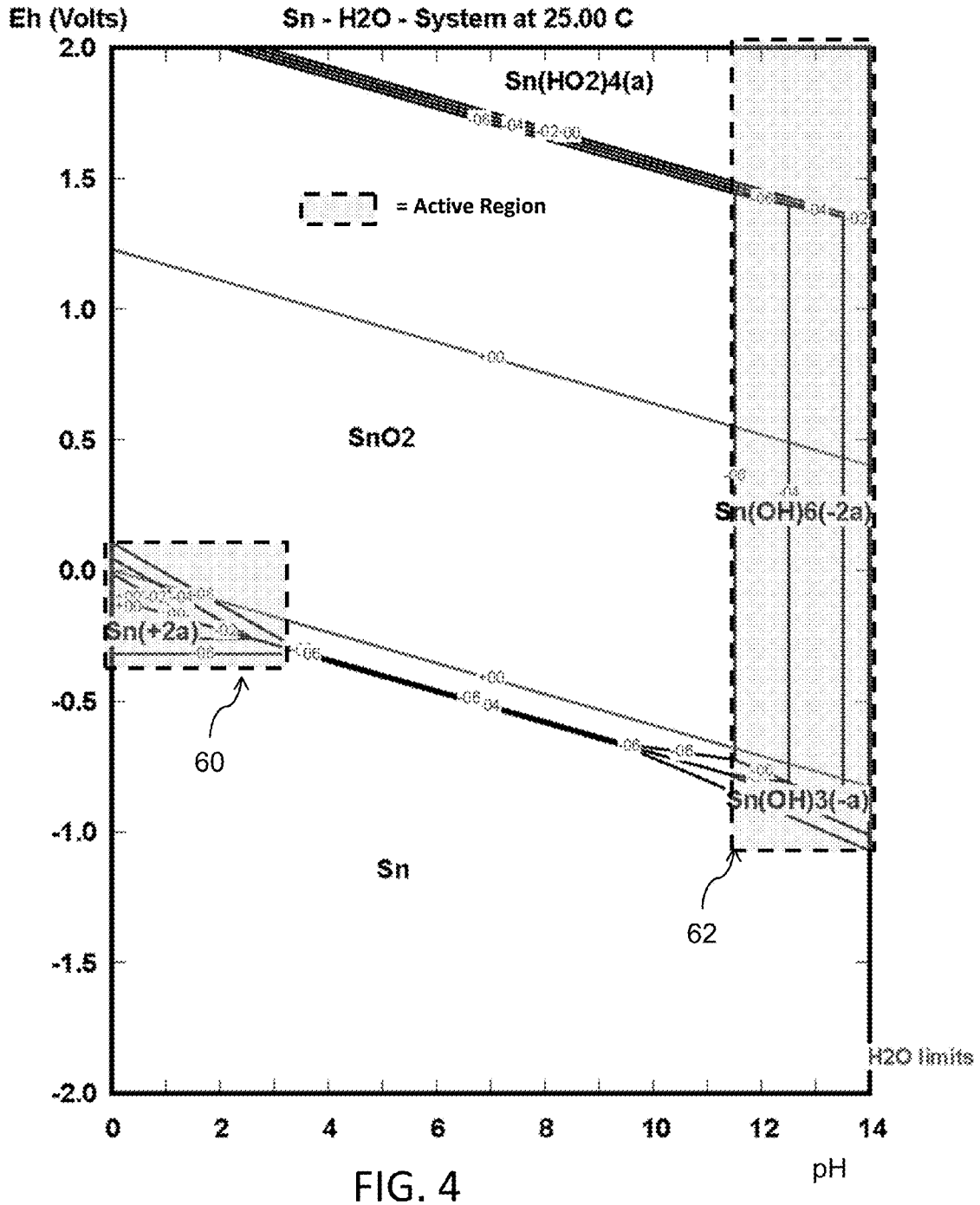
FIG. 4 is a potential-pH equilibrium diagram (Pourbaix Diagram) showing operating regions for the additive manufacturing method in the case of tin-water at 25° C.

FIG. 4 shows an analogous plot for tin-water at 25° C., based on Pourbaix 1974, p. 479.

An exemplary manufacturing process using this methodology may thus include exposing a powder in a mold of the shape desired to an acidic or alkaline solution and optionally applying a voltage, at or near the ion dissolution point of the metal. The appropriate dissolution point can be found using the Pourbaix Diagram and the Nernst Equation. The Nernst equation operating regions 60 and 62 may be identified using the Pourbaix diagram based on where the element dissolved in the acid or base.

Powder may also be added and exposed at different times to build more complex shapes. Acid or base corroding material may also be used to create more complex shapes.

In the case of alloys, the Pourbaix diagram for one of the constituent metals in the alloy may be selected to determine an appropriate operating region. In this case, the particles in the resulting composite may be bound together predominantly by redeposited metal derived that metal in the alloy, (unless the two or more metals in the alloy have similar operating regions). A post synthesis heat treatment may be applied to increase diffusion of the metals into each other and result in a more homogeneous material.

Theory of Consolidation

Without being bound by any particular theory, physical and chemical reactions that may take place during the process and possible underlying mechanisms that drive the observed powder consolidation are suggested.

Figure 5:
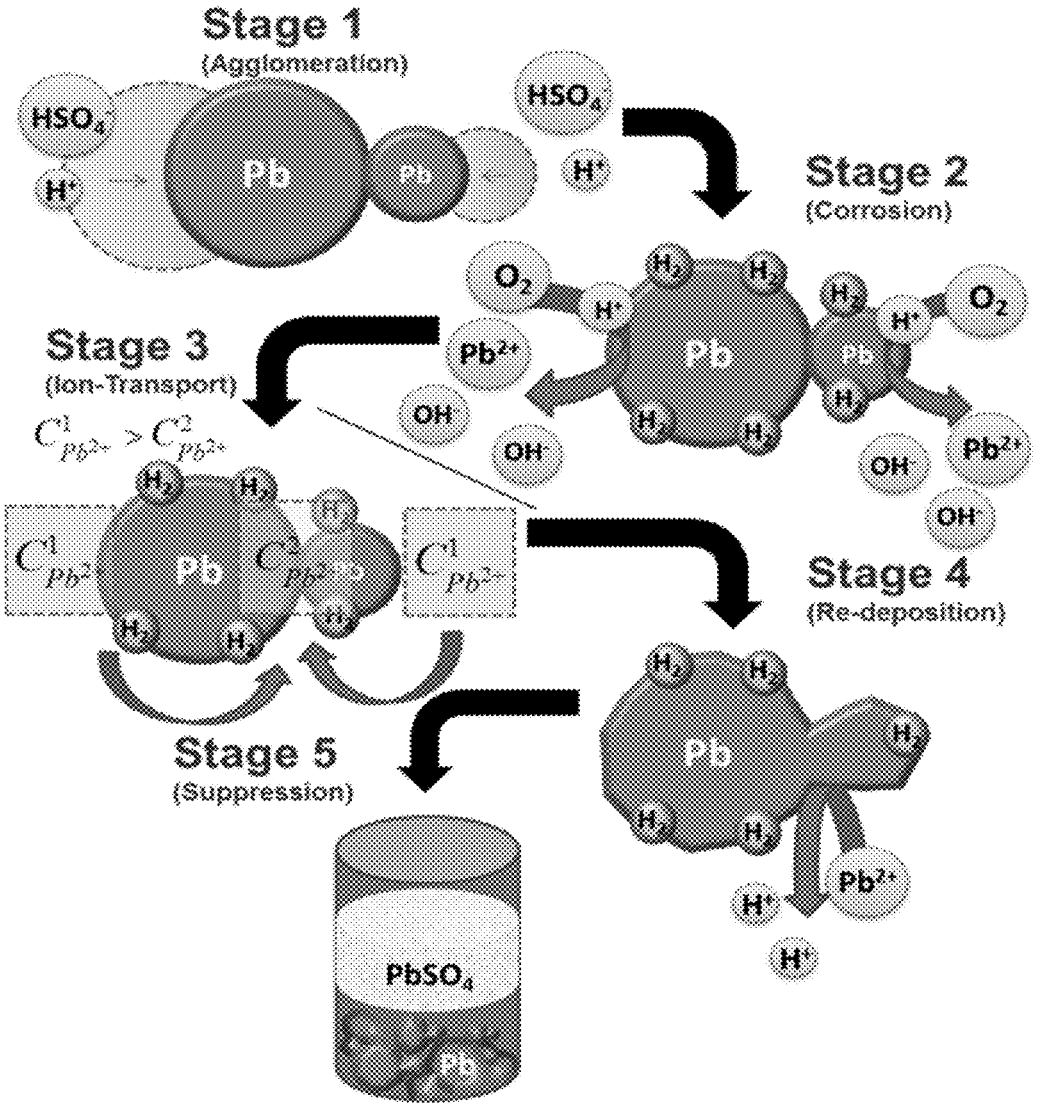
FIG. 5 graphically illustrates a theoretical model of chemically-driven consolidation and solidification of agglomerated particles in five stages.

The consolidation behavior observed in the exemplary method can be described by a five-stage model, as shown in FIG. 5. The stages include 1. agglomeration; 2. corrosion; 3. ion transport; 4. re-deposition; and 5. suppression. These proposed stages have been validated, at least in part, through experiments described below.

1. Agglomeration

During the agglomeration stage, particles make contact and stick together to form larger aggregates. The driving mechanisms for particle movement and the resulting particle-particle collisions are likely Brownian motion, advection due to laminar or turbulent flow, gravitational settling, and electrostatic migration caused by the presence of an electrical field (see, e.g., Flagan, R. C. Dynamics of pyrogenous fumes.

*Fuel Process. Technol.* 39, 319-336 (1994); Sze, A., et al. Zeta-potential measurement using the Smoluchowski equation and the slope of the current-time relationship in electroosmotic flow. *J. Colloid and Interface Sci.* 261, 402-410 (2003); Chen, X. J., et al. Hamaker-constant calculations and surface melting of metals, semimetals and semiconductors. *Nuovo Cimento Della Societa Italiana Di Fisica D-Condensed Matter Atomic Molecular and Chemical Physics Fluids Plasmas Biophysics* 13, 919-937 (1991)).

The electrostatic forces are thought to be created by the surface charge and the charged ion barrier surrounding each individual particle as described by the Derjaguin and Landau, Verwey and Overbeek (DLVO) theory (see, e.g., Lyklema, J., et al. DLVO-theory, a dynamic re-interpretation. *Adv. Colloid Interface Sci.* 83, 33-69 (1999); Segets, D. et al. Experimental and Theoretical Studies of the Colloidal Stability of Nanoparticles—A General Interpretation Based on Stability Maps. *ACS Nano* 5, 4658-4669 (2011)).

The determination of whether particles stick together is then dependent on whether attractive van der Waals forces or the repulsive electrostatic forces dominate.

Typical agglomeration models begin with von Smoluchowski's growth model for determining changes in the particle size, q, based on an initial particle size distribution (see, e.g., Von Smoluchowski, M. *Physik. Zeit.* 17, 557-571, 585-599 (1916); Kang, K. et al. Fluctuation Effects in Smoluchowski Reaction-Kinetics. *Physical Review A* 30, 2833-2836 (1984); Heine, M. C., et al. High concentration agglomerate dynamics at high temperatures. *Langmuir* 22 (2006); Wattis, J. A. D. Exact solutions for cluster-growth kinetics with evolving size and shape profiles. *J. Phys. A-Math. Gen.* 39, 7283-7298 (2006); Loyalka, S. K. Brownian coagulation of aerosols. *J. Colloid and Interface Sci.* 57, 578-579 (1976); Kim, J., et al. Improved orthokinetic coagulation model for fractal colloids: Aggregation and breakup. *Chem. Eng. Sci.* 61, 45-53 (2006)). In this approach, changes in the particle size, q, based on an initial particle size distribution are a function of the parameters shown in Eqn. 6:

$$\frac{dq_i(t)}{dt} = \frac{1}{2}\sum_{0}^{i} k(i,\ j-i)q_i(t)q_{j-i}(t) - q_i(t)\sum_{j=1}^{\infty} k(i,\ j)q_j(t). \tag{6}$$

Eqn. 6 can be broken down into the contributions of two different mechanisms. The first part of Eqn. 6 represents the gain of agglomerated particle clusters of the i-th diameter and the second part accounts for the loss of particles of i-th diameter, with the k(i,j–i) and k(i,j) being the respective rate kernels. Determination of the agglomeration rate thus depends on the operating mechanisms, which in turn is a function of the particle's sticking efficiency, velocity, and collision cross-section (see, e.g., Blum, J., Grain Growth and Coagulation. *Astrophysics of Dust, ASP Conference Series* 309, 24 (2003)).

The operating mechanisms may include Brownian motion, gravitational settling, as well as turbulent and laminar flow, all of which affect the velocity component of the agglomeration rate kernel that drives particle-to-particle collisions. A model that links the particle stability in the suspension to established heat and mass transfer correlations can be derived by considering convective agglomeration with settling effects, in order to determine the rate kernels. The ratio of the convective agglomeration, k(i,j), to the Einstein-Stokes diffusion can be based on the Schmidt number ($N_{Sc}$), the Reynold number ($N_{Re}$), and the particle stability number ($N_{ps}$) according to:

$$\frac{k(i,\ j)}{\mu_m k_B T(d_i + d_j)} = \beta C_1 (N_{Sc})^{C_2} (N_{Re})^{C_3} N_{ps}^{C4} \tag{7}$$

where β is a coefficient that takes into account the shape and elasticity of the particles, $\mu_m$ is particle mobility, $k_B$ is the Boltzmann constant, T is the temperature, and $C_1$-$C_4$ are experimentally determined constants. The particle stability number, $N_{ps}$, accounts for gravitational settling and potential particle-to-particle interactions that effect particle stability in a solution and is a function of the particle's Reynold number, Archimedes number ($N_{Ar}$), and Stokes number ($N_{St}$) as follows:

$$N_{ps} = \frac{N_{Re}}{(N_{Ar})N_{St}} = \frac{18^2\mu^2}{gd^3\left(\frac{d_i}{d_j}\right)(\rho_P - \rho_f)^2} \tag{8}$$

where $d_i$ and $d_j$ are the particle diameter for particles i and j, respectively, $\rho_P$ is the particle density, $\rho_f$ is the fluid density, μ is the dynamic viscosity of the fluid, and g is the gravitational constant.

The event of a particle collision does not necessarily mean that the particles will stick together and form an agglomerate. The "sticking efficiency" also depends on the particles' material properties, particularly elasticity, hardness, and Hamaker constant for van der Waals forces, as well as its surface charge (see, Delahay, P. Double layer and electrode kinetics. (Interscience Publishers, 1965); Duduta, M., et al. Semi-solid lithium rechargeable flow battery. *Advanced Energy Materials* 1, 511-516 (2011)).

In terms of particles in aqueous solutions, the pH and ionic salt concentration also affect the particle's surface charge and resulting zeta potential, which may counteract the attractive van der Waals forces to some degree and prevent or inhibit agglomeration (see, Anh Ho, C., et al. Modelling of microparticle agglomeration in turbulent flows. *Chem. Eng. Sci.* 57, 3073-3084 (2002)).

The pH of the solution thus not only determines the number of hydrogen or hydroxide ions present for adsorbing onto the surface of the particle, but also dictates the surface chemistry of the metal particles, for example, whether a metal hydroxide or oxide exists on the particle surface (see, e.g., Xie, Z. P., et al. Effects of dispersants and soluble counter-ions on aqueous dispersibility of nano-sized zirconia powder. Ceramics Intern'130, 219-224 (2004); Andal, V. et al. Synthesis of nano CuO by polymeric precursor method and its low temperature reduction to stable copper nanoparticles. *J. Nano Res.* 15, 11-20 (2011).

2. Corrosion

The second stage involves the corrosion and dissolution of the metal as hydrogen ions and dissolved oxygen serve as oxidizing agents, creating metal ions on the surface of the particles.

Corrosion occurs when a metal is exposed to an electrolyte solution, whereas the exact mechanism and reaction kinetics strongly dependent on the chemical and physical environment of the metal. For example, in the acidic pH region, hydrogen ions ($H^+$) and dissolved oxygen ($O_2$) are the two main oxidizing agents causing the dissolution of the exposed metal (M) surfaces according to:

$$\text{Anodic Reactions: } 2H^+ + 2e^- \rightarrow H_{2(g)}\ 0\text{V vs NHE} \tag{9}$$

$$O_{2(g)} + 4H^+ + 4e^- \rightarrow 2H_2O_{(l)}\ 1.23\text{V vs NHE} \tag{10}$$

$$\text{Cathodic Reaction: } M \rightarrow M^{x+} + xe^-\ 0\text{V vs NHE} \tag{11}$$

The listed voltages are the standard redox potentials with respect to the normal hydrogen electrode (NHE). In most cases, the dissolved metal cations ($M^{x+}$) are transported away from the surface, form a salt with anions in the electrolyte, and precipitate out of the solution. However, under certain conditions, a re-deposition of the metal ions can occur, even without a change in temperature.

The hydrogen ions form hydrogen gas that is adsorbed onto the surface of the particles and remains present at the surface participating in future reactions. (see, Marsalek, R. The Reduction of Zinc using Goethite Process and Adsorption of $Pb^{+II}$, $Cu^{+II}$ and $Cr^{+III}$ on Selected Precipitate. *Intern'l J. Environmental Sci. and Dev't* 2 (4) 255-258 (2011)).

Corrosion thus plays two roles in the CDPC process. First, the breakdown of oxide films on the surface of metal particles caused by corrosive oxidizing agents increases the potential for agglomeration by decreasing the electrostatic repulsive force and the contact resistance between the particles. Second, the electrochemical potential between the oxidizing agent and the metal surface determines whether re-deposition occurs and drives the growth pattern of the newly re-deposited metal. As discussed above, the thermodynamically stable phase of a material as a function of pH can be determined using a Pourbaix diagram, as in FIG. 3. The Pourbaix diagram also indicates whether re-deposition is likely to occur for a given metal.

A corrosion reaction to note is the formation of gaseous hydrogen by the hydrogen ions present in the solution. The dissolved oxygen competes with hydrogen ions for the anodic dissolution of the metal and has a much greater reaction potential. In the case of Pb, the overall reaction potential between Pb and O is −1.06 V (at standard conditions), which is an order of magnitude greater than that of hydrogen ions and Pb. Thus the reaction is generally considered mass transfer limited and irreversible. (see, Ilic, V. & Phanthien, N. Viscosity of concentrated suspensions of spheres. *Rheologica Acta* 33, 283-291 (1994)). The agglomeration of suspended crystals and resultant strengthening of consolidated agglomerates due to re-deposition and crystallization has been studied (see, David, R., et al. Developments in the understanding and modeling of the agglomeration of suspended crystals in crystallization from solutions (2003)). The strengthening rate between the particles was found to be a function of the supersaturation of the solution.

3. Ion Transport

The third stage is controlled by mass transport. Metal ions in the solution are subject to diffusion, advection, and electromigration in accordance with the Nernst-Planck equation (see, Mirza, S., et al. Sedimentation of Suspensions of Particles of Two or More Sizes. *Chem. Eng. Sci.* 34, 447-454 (1979); Park, H. M., et al. Comparison of the Nernst-Planck Model and the Poisson-Boltzmann Model for Electroosmotic Flows in Microchannels. *J. Colloid and Interface Sci.* 315, 731-739 (2007)).

The mass transport of metal ions formed by corrosion creates equilibrium imbalances and sets the conditions for potential re-deposition. The metal ions in the solution are subject to advection, diffusion, and electro-migration and can be analytically determined using the Nernst-Planck equation. It is well known that advection, or movement induced by the bulk fluid, influences the migration of ionic species in aqueous solutions (see, Newman, J. T.-A., et al. Electrochemical Systems. Third Edition edn (Wiley, 2004); Bard, A. J. et al. Electrochemical Methods: Fundamentals and Applications. (Wiley, 2001).

In static bulk solutions, ion transport exists due to diffusion and electro-migration. The electro-migration is largely dependent upon the charges of the ions present in the solution and potential presence of external electromagnetic fields. More important for the consolidation process, however, is likely the diffusion of metal ions due to concentration gradients, which may result from the side-dependence of the dissolution rate of the individual particles and mass transport limitations in confined spaces, for example in pores that form between agglomerated particles. The higher concentration of metal ions resulting from increased dissolution rates of smaller particles is attributed to the increased surface-to-volume ratio and Gibbs free energy of the surface. When supersaturation conditions are present, crystal growth theory and the well-known Ostwald-Freundlich equation (or Gibbs-Thomson relation) can be used to explain concentration variance based on particle size (Shchekin, A. K., et al. Generalization of the Gibbs-Kelvin-Kohler and Ostwald—Freundlich Equations for a Liquid Kilm on a Soluble Nanoparticle. *J. Chemical Physics* 129, 154116-154115 (2008)). Under a certain critical size, the level of supersaturation increases for decreasing particle size. The increase in the mass transport of dissolved ions from smaller particles to bigger particles increases the equilibrium imbalance and results in re-deposition.

4. Re-Deposition

The fourth stage involves re-deposition of the metal onto the surface of the particles due to equilibrium imbalances and the resulting consolidation effect.

Metal particles exposed to corrosive conditions that lack protective oxide films are susceptible to agglomeration and potential re-deposition depending on the reaction kinetics and surface conditions. The driving force behind the re-deposition process is believed to be supersaturated crystal growth created by the corrosive environment and driven by equilibrium imbalances and lower energy nucleation sites that result from the agglomeration process (De Yoreo, J. J., et al. Principles of Crystal Nucleation and Growth. *Reviews in Mineralogy and Geochemistry* 54, 57-93 (2003)).

For the re-deposition of the metal ions to occur, a reducing agent is needed. Exemplary reducing agents include Pb from a different location on the particle surface or adsorbed hydrogen gas from the corrosion stage:

$$Pb^{2+}+H_{2(g)}\rightarrow Pb+2H^{+}0.12V\ @\ 20^{\circ}\ C. \quad (12)$$

In both cases, localized equilibrium imbalances drive the oxidation-reduction reaction.

The result of the re-deposition of mass is consolidation. The consolidation and densification depends upon the fractal dimension (D) of the agglomerates formed, which in turn is proportional to the final mass (m) of the aggregate according to Flagan (Flagan, R. C., Dynamics of pyrogenous fumes. *Fuel Process. Technol.* 39, 319-336 (1994):

$$m\propto r^{D} \quad (13)$$

where r represents the radius of the particle. Formation of denser agglomerates with higher fractal dimensions are generally broken down into two types: diffusion limited aggregation (D≈2.4) and cluster-cluster aggregation (D≈1.8) (see, Zhao, Y. Y., et al. and Mirza, et al., discussed above). Diffusion limited aggregation (DLA) results from individual particles diffusing into larger agglomerates. Cluster-cluster aggregation (CCA) occurs when like-sized agglomerate clusters coagulate.

5. Suppression

The final step is the result of several disruptive mechanisms that inhibit/prevent a further re-deposition of metal, including mass transport limitations, formation of salts, and the system achieving chemical equilibrium.

Ion transport in a static system without agitation is driven by diffusion and electrostatic migration and will eventually come to a steady state allowing for the total system to come to equilibrium. When the fluid is in motion, as with the case of agitation, advection increases mass transport and changes the equilibrium chemical kinetics. This coupled with the difference in supersaturation and surface energy between particles drives the CDPC process. Over time, the process will cease when the dissolved ion concentration on the surface of the agglomerates reaches equilibrium at some critical size ($d_{critical}$). Additionally, the presence of anions in the solution has the potential for the metal ions to form insoluble salts. Salt formation can cause surface films on the particles or consume and precipitate the metal ions out of the solution resulting in the suppression of the process (see, Pourbaix). In the case of Pb in sulfuric acid, the formation of $PbSO_4$ tends to stifle the re-deposition process.

$$Pb^{2+}+SO_4^{2-}\rightarrow PbSO_4-0.26\text{ V @ }20^\circ\text{ C.} \quad (14)$$

Sulfuric acid in the four to six molar concentration range works well due to the multiple dissociation reactions that occur for the release of hydrogen ions (Danel, V. et al. Study of Pb(II) in various $H_2O$—$H_2SO_4$ mixtures by differential pulse polarography: Solubility of lead sulfate, diffusion-coefficient of Pb(II) and half-wave potential of Pb(Hg)/Pb(II). *Electrochim. Acta* 27, 771-774 (1982)). At 20° C., the first dissociation is strong and has a reaction potential of −0.68 volts; however, the second dissociation reaction is weak with a positive reaction potential of 0.11 volts.

$$H_2SO_{4(l)}\rightarrow H^++HSO_4^-\ -0.68\text{ V @ }20^\circ\text{ C.} \quad (15)$$

$$HSO_4^-\rightarrow H^++SO_4^{2-}\ 0.11\text{ V @ }20^\circ\text{ C.} \quad (16)$$

The result of the multiple dissociations is a high initial concentration hydrogen and bisulfate ($HSO_4^-$) ions for the corrosion of the Pb and a low concentration of sulfate ions for $PbSO_4$ formation. Over time, $PbSO_4$ will form as the system reaches equilibrium; however, the kinetics are relatively slow as can be seen with the self-discharge of lead-acid batteries. When the system reaches equilibrium or all the metal ions are consumed, the CDPC process ends.

The theory described above suggests that both particle size and shape affect agglomeration rates and the re-deposition process. Larger particles will form larger agglomerates but may require more energy to keep suspended. Smaller particles increase the re-deposition process and require less energy to keep suspended.

The concentration of metal ions above the surface of the particle depends upon the exposed surface area and hence the particle size. Smaller particles have a larger surface area and, hence, a higher concentration of ions which results in diffusive mass transport of the ions from smaller particle to the larger particles based on the concentration gradient. The particle size distribution greatly affects agglomeration rates as well with a broader size distribution generally resulting in increased agglomeration based on smaller particles tending to collide and stick to the larger particles.

In the case of Pb, for example, tests show that 200 mesh powder with a particle size distribution range spanning <1 to 74 micrometers can form a 3.5 cm aggregate in 2 hours compared to a 325 mesh power with a size distribution range of <1 to 44 micrometers in 48 hours. Therefore, optimizing the particle distribution range is advantageous for controlling the CDPC process. The shape changes the kinematics of particle-to-particle collisions for agglomeration and the surface area aspect of the surface energy. The crystallinity and surface structure also affect the agglomeration and re-deposition process by changing the elastic properties of particles and the surface energy, respectively.

The surface potential plays a key role in the re-deposition stage and can be controlled using surfactants, potential-control agents, such as hydrogen peroxide or vanadium oxide, or direct application of an external voltage potential. In the case of Pb powder in sulfuric acid, Rhodamine B can be used to slow the CDPC process. For example, when 5% (by weight) Rhodamine B was added to Pb powder (325 mesh) and stirred for 4 h in a solution of 2M sulfuric acid, particle agglomeration rates were reduced but centimeter sized aggregates still formed.

Another control mechanism is the amount of dissolved oxygen in the solution. As previously discussed, dissolved oxygen competes with the hydrogen ions for the corrosion of the metal surface and has a much great reaction potential. In the case of Pb, dissolved oxygen facilitates dendrite crystal growth while hydrogen ions enable faceted crystal growth. The faceted crystal growth allows for a more compact and dense aggregate and supports the controlling of the densification by the amount of oxygen dissolved in the solution. Temperature also plays a role and can greatly affect chemical reaction kinetics, fluid properties, phase changes, and ionic solubility. Furthermore, it was observed that agitation mechanisms can be used to decrease the agglomeration time and increase the rate of the densification process by particle and ionic mass transport, respectively. These mechanisms may include ultrasonic agitation, stirring, shaking, and other mechanisms that cause solid particle and ionic mass transport in addition to creating an equilibrium imbalance. A centrifuge device that creates a centrifugal force could also increase in agglomeration rates based on the particle kinematics and the increase in ionic mass transport based on the concentration gradients created from particle size separation. Considering that the CDPC process is theoretically based on equilibrium imbalances, the feed rate at which the powder is exposed to the corrosive solution can be used to control the process and can be optimized based on chemical and agglomeration kinetics.

The morphology can be controlled using a mold or layer based approach. To improve the aggregate's physical properties, the consolidated aggregate can be modified using conventional methods, which include sintering, cutting, and polishing.

As will be appreciated, there may be some metal and acid/base combinations which do not result in good powder agglomeration and consolidation. Metals that form stable surface complexes (e.g., hydrates) or insoluble salts with a given acid or base chemistry may be unsuitable. An example for such a metal/acid combination is nickel/sulfuric acid. Nickel forms an insoluble nickel sulfate salt in strong sulfuric acid. Metals that have a high or low surface potential relative to the oxidizing agents present, as can often be seen on Pourbaix diagrams, may have too large a potential difference for the re-deposition of material to occur in a reasonable time period. Additionally, metals with multiple valence states could disrupt the re-deposition process as observed with copper in strong sulfuric acid, which has the valence states of +1 and +2 within 0.4 volts.

Potential Applications of the Exemplary Solidification Process

1. Low cost manufacturing of porous and nonporous metal electrodes for energy storage applications (e.g. lead acid batteries).

2. Low-cost fabrication of metal parts with complex shapes.

3. Production of Metal Foams for Catalysis, Energy Conversion and Storage, and Water/Air Purification.

4. Production of Alloys and Nanocomposites.

The proposed process can also be combined with other manufacturing techniques, such as spin casting and nano-dispersion strengthening, to obtain the solidification of solid metal objects with desired morphology and improved properties.

Without intending to limit the scope of the exemplary embodiment, the following Examples demonstrate the applicability of the method.

EXAMPLES

Materials and Methods

Pb powder was obtained from Atlantic Equipment Engineers (325 mesh) and Alfa Aesar (200 mesh). Zn powder was obtained from Sigma Aldrich. Sn powder was obtained from Alfa Aesar. The Pb powder was sieved to provide the desired particle size range. None of the powders were ground, except zinc, which was ball milled.

Density Measurements

Density measurements were taken using a Denver Instruments Timberline series balance for obtaining the mass and a 10 milliliter graduated cylinder for measuring the volume. High viscosity (60,000 cP) silicon oil was used as the fluid to reduce the absorption of the fluid into the pores of the aggregates.

Scanning Electron Microscope (SEM) with Focused Ion Beam (FIB) Measurements

SEM images were collected by a Zeiss Neon 40 microscope using a field emission source and secondary electron images were collected. Electron beam energy ranged for 10-20 kV. Focused ion beam cuts were made using a Ga ion source with 5 nA/30 kV for the primary cuts and 200 pA/30 kV for polishing cuts.

Energy Dispersive X-Ray Spectroscopy (EDS) Measurements

EDS measurements were taken in conjunction with the SEM using an EDAX Apollo 10 SDD spectrometer. Data was collected and analyzed using Genesis Spectrum software.

X-Ray Diffraction Measurements

XRD experiments were performed by a Panalutical PW1830 apparatus using Bragg-Brentano $\theta/2\theta$ geometry with a copper source. The samples were mounted on either of two holders: a low background Si holder with a cavity for holding packed powder samples and an aluminum plate with carbon tape/modeling clay to hold the solid samples. Data was collected using X'Pert Data Collector software and then analyzed and displayed using the X'Pert High score software.

Particle Size and Agglomeration Measurements

Particle size and agglomeration measurements were performed by a Horiba Partica LA-950 Laser Diffraction Particle Size Distribution Analyzer using a wet half-cell configuration with maximum stir bar agitation. Samples tested consisted of 9.5 mL of a 4M $H_2SO_4$ solution and 50 mg of 99.9% Pb powder from Atlantic Equipment Engineers (325 mesh) and Alfa Aesar (200 mesh). Powders were sieved in a Retsch AS200 Digit for 1 h in 15 min increments. Powder samples were taken from the middle of the bulk powder containers after being mixed for 12 h on a roller powder mixer and were taken within 5 min of a measurement. The index of refraction used for 4M $H_2SO_4$ solution was 1.37 and for Pb for a 650 nm Laser Diode (1.6 mW) light source was 1.91. Data was collected using Horiba Instrument software and then analyzed and displayed using the Horiba Instrument software and MATLAB.

Example 1

Lead Powder Solidification in Acidic and Alkaline Solutions

For lead-water at 25° C., The Pourbaix Diagram of an aqueous solution containing lead as shown in FIG. 3 was used to select a suitable operating region.

According to the above Pourbaix diagram, the suitable operating regions for the manufacturing of solid lead from lead power can be summarized as shown in TABLE 1:

TABLE 1

Operating regions for lead aggregation in an aqueous solution at 25° C.

| Material | Symbol | pH | Voltage Range |
|---|---|---|---|
| Lead | Pb | <6 and >14.4 | 0.1 V to −0.4 V Acidic<br>0.1 V to −0.7 V Alkaline |

A series of agglomeration experiments was conducted to demonstrate the feasibility of the process.

i) Lead Agglomeration in Low pH Regime a) With Agitation

Lead powder (200 mesh size) was placed in a 2M solution of sulfuric acid. After ultrasonic agitation for 1 hour, the powder particles were fully agglomerated and formed a large solid aggregate of lead.

Lead powder (325 mesh size) was placed in a 4M solution of sulfuric acid. This time, mechanical agitation in form of continuous stirring was applied for 4 hours. Formation of large agglomerates was observed.

In another experiment, micrometer-sized Pb powder was exposed to a 4M solution of sulfuric acid (pH<0) and mechanically stirred using a magnetic stir bar at room temperature (25° C.) for 130 hours. Upon pouring the dark grey powder in the acidic solution, small gas bubbles were observed, indicating the formation of $H_2$ in accordance with the corrosion reactions (1) and (3). After a few hours, the powder particles lightened in color and increased in size. The dark grey color of the as-received powder indicates the presence of an oxide layer at the particle surface, which dissolves in the strong acid, resulting in the lighter grey color of metallic Pb. Centimeter-sized aggregates were observed after about 2 days and small white particles appeared in the solution. The experiment was ended after 130 hours and the aggregates were removed. The Pb agglomerates thus produced could not be easily broken-up by physical agitation.

Figure 6:
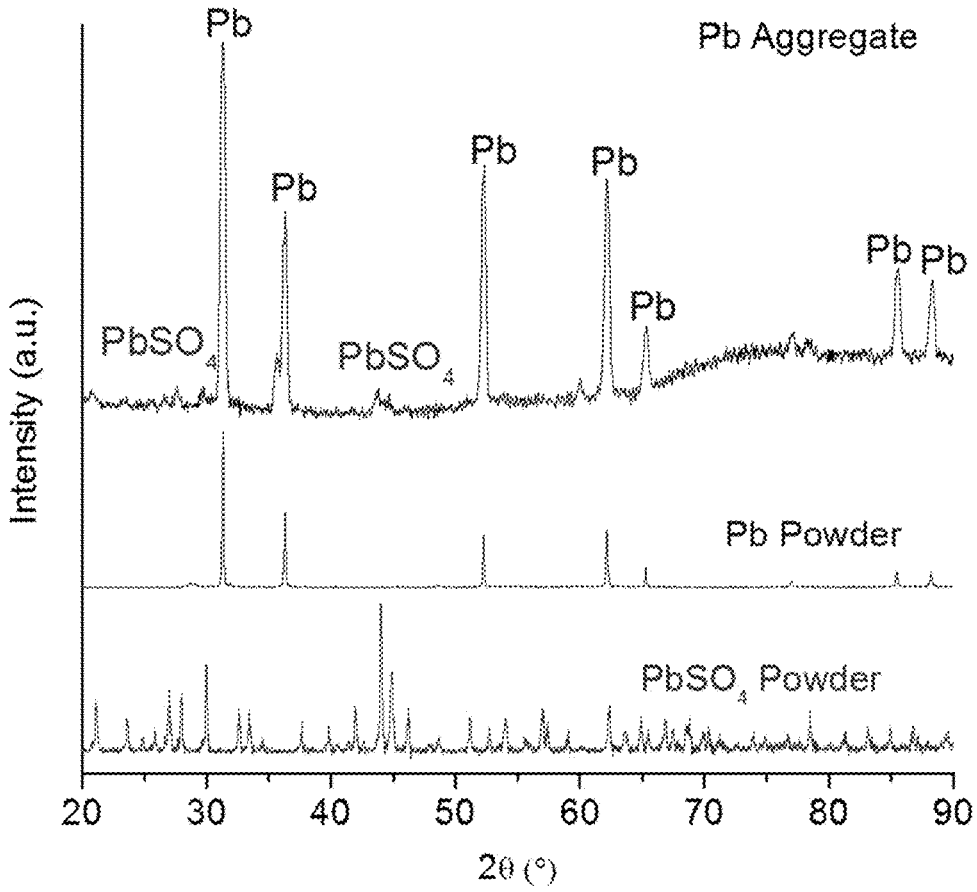
FIG. 6 shows X-ray diffraction (XRD) analysis-XRD patterns of formed Pb aggregate, as-received Pb powder, and a $PbSO_4$ reference powder.

In order to obtain a better understanding of the observed consolidation process and to verify the presence of metallic Pb, the consolidated aggregates were analyzed using X-ray diffraction (XRD). XRD probes the crystal structure of a material and can thus be used to identify elements and compounds. FIG. 6 compares the XRD pattern of one of the consolidated aggregates to that recorded from the as-received Pb powder and a $PbSO_4$ reference powder. The formation of $PbSO_4$ is expected as Pb is thermodynamically unstable in sulfuric acid. The conversion of Pb to $PbSO_4$ also causes the self-discharge in conventional lead acid batteries. The XRD pattern of the aggregate shows traces of $PbSO_4$, likely located at the particle surface, with the majority of the aggregate being composed of metallic Pb. The formation of $PbSO_4$ on the particle surfaces may also contribute to the observed color change from a dark to a light grey upon acid exposure.

Figure 7:
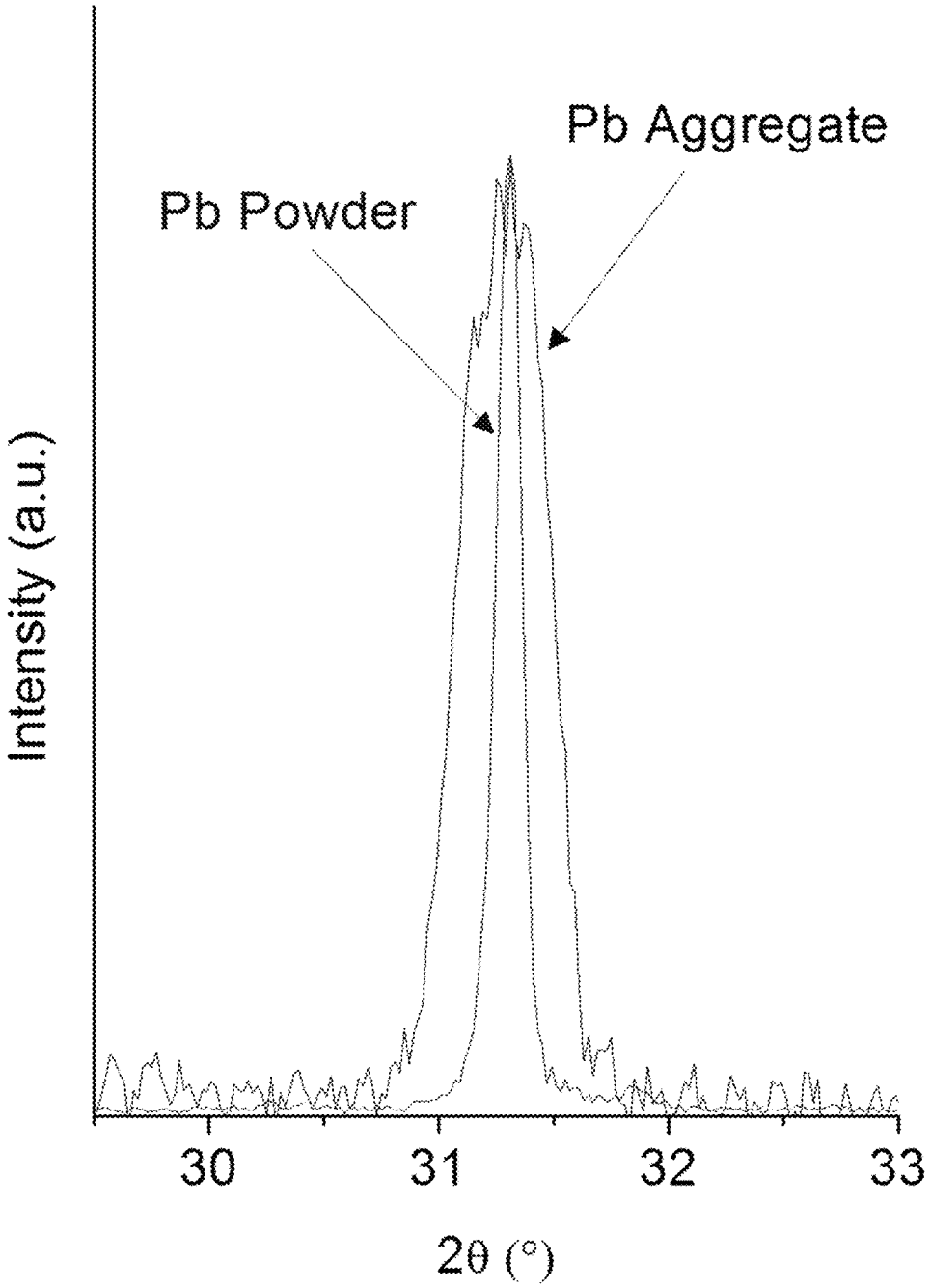
FIG. 7 shows X-ray diffraction (XRD) analysis-Magnification of the (111) peak of FIG. 6.

FIG. 7 shows a magnification of the Pb (111) peak. It can be noted that the diffraction peaks of Pb are significantly broadened after consolidation, as compared to the as-received powder. In XRD analysis, peak broadening is causes by three primary factors: crystal size reduction, residual strain, and instrumental broadening. While the latter can be determined using a XRD standard (e.g., lanthanum hexaboride), Williamson-Hall Analysis (WHA) or similar techniques can be used to distinguish between the contributions from crystal size and lattice strain.

Figure 8:
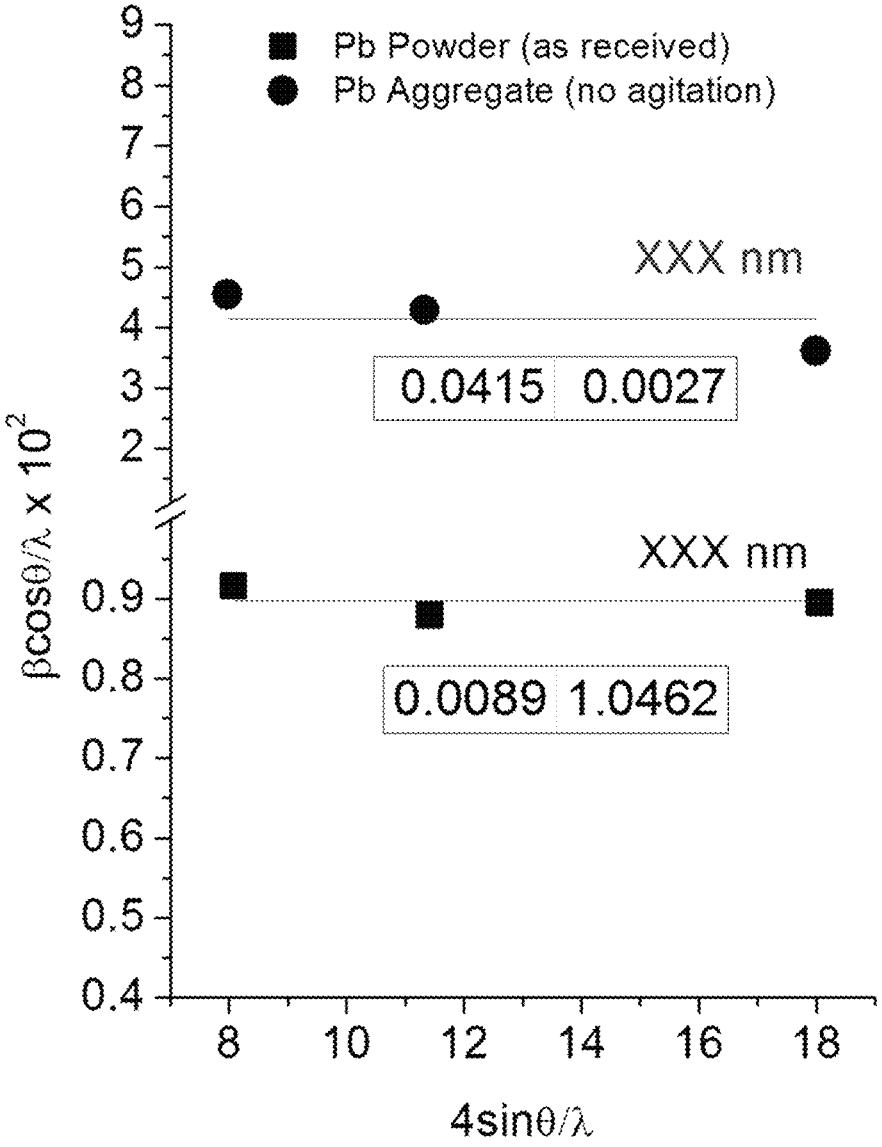
FIG. 8 shows X-ray diffraction (XRD) analysis-peak widths used to determine the crystal size by Williamson-Hall analysis.

In the case of WHA, plotting $\beta \cos \theta/\lambda$ versus $4 \sin \theta/\lambda$ yields a straight line (FIG. 8), where $\beta$ is the observed integral breadth of the diffraction peak after accounting for the instrumental broadening, $\theta$ is the diffraction angle, and A is the wavelength of the X-ray radiation. The slope of the curve contains information on the residual strain, whereas the intercept with the y-axis indicates the crystal size. To simplify the analysis, it may be assumed that the contributions from lattice strain are negligible by setting the slope of the regression line to zero. The crystal sizes were found to be 102 nm and 17 nm for the as-received Pb powder and the consolidated aggregate, respectively. Size calculations were performed by the method of Woo, D. J., et al. (Synthesis of nanodiamond-reinforced aluminum metal composite powders and coatings using high-energy ball milling and cold spray. *Carbon* 63, 404-415 (2013)). The analysis reveals that the average crystal size of the agglomerate is smaller than that of the as-received powder, which cannot be explained by the conventional van der Waals-type agglomeration process, assuming that the agitation forces are not sufficient to cause the fracture of Pb grains, a phenomenon known from high energy ball milling.

b) Without Agitation

Pb powder was added to a 4M sulfuric acid solution without agitation. Similar to the previous experiment, the color of the powder changed from a dark to a light grey after a couple of days and a small amount of hydrogen gas was formed; however, the results differed in that the powder took on the morphology of the bottom of the container, showing less densification and reduced material strength, as compared to the agglomerates formed under agitation. The loosely formed aggregate could not support its own weight and broke into smaller pieces when removed from the container. The presence of the white $PbSO_4$ particles in the container was not as prevalent as in the agitated sample. These results suggest that agitation plays a useful role in the agglomeration and redeposition process.

ii) Lead Agglomeration in High pH Regime

Lead powder (325 mesh size) was placed in a 10M solution of potassium hydroxide. After ultrasonic agitation for 1 hour, the powder was fully agglomerated. When immersing the lead powder in a 14M solution of potassium hydroxide, full agglomeration occurred in less than 5 minutes, without agitation. This demonstrates that rate of the aggregation process can also be controlled by pH level.

iii) Lead Agglomeration in High pH Regime Using a Semi-Cylindrical Mold

Lead powder (200 mesh size) was placed in a semi-cylindrical mold containing a 4M solution of sulfuric acid. No agitation mechanism was applied. The agglomeration led to formation of a semi-cylindrical piece of solid lead.

iv) Lead Agglomeration in Low pH Regime Using Surfactant Additive

Lead powder (325 Mesh size) was stirred for 4 hours in a solution of 2M $H_2SO_4$ that contained 5 wt % Rhodamine B surfactant. Rhodamine B reduced the agglomeration rate, allowing for the fabrication of a more dense solid. This suggests that surfactant may be used to control the density/porosity of the solid to be produced.

v) Particle Size Influence on Lead Agglomeration

The particle size distribution greatly affects agglomeration rates with a broader size distribution generally resulting in increased agglomeration based on smaller particles tending to collide and stick to the larger particles. This can lead to an increase in the aggregate size and decrease in process time.

Figure 9:
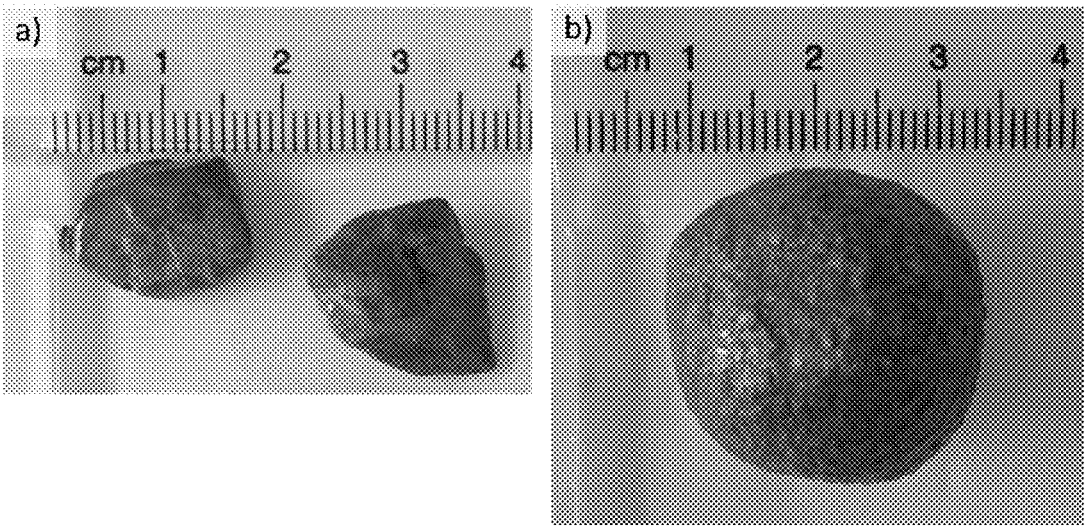
FIG. 9 shows Pb aggregates formed based on different particle size distributions: a) Pb aggregate created from 325 mesh powder (<1-74 μm size distribution range) exposed to a 4M $H_2SO_4$ solution after being mechanically stirred for 48 hours, and b) 200 mesh powder (<1-44 μm size distribution range) exposed to a 4M $H_2SO_4$ solution after being mechanically stirred for 2 hours.

Lead powder, 200 mesh size, with a particle size distribution range spanning <1 to 74 micrometers, formed a 3.5 cm aggregate in 2 hours when exposed to a 4M $H_2SO_4$ solution, which was mechanically stirred, as compared to a 325 mesh power with a size distribution range of <1 to 44 micrometers, which formed somewhat smaller aggregates in 48 hours (FIG. 9).

The time-dependent changes in the size distribution of four Pb powders with different particle sizes were investigated using dynamic light scattering. The four powders were produced by sieving the as-received Pb powder (200 mesh size) into four samples with narrower, more defined size distributions (25-37, 38-44, 45-52, and 53-62 μm).

Figure 10:
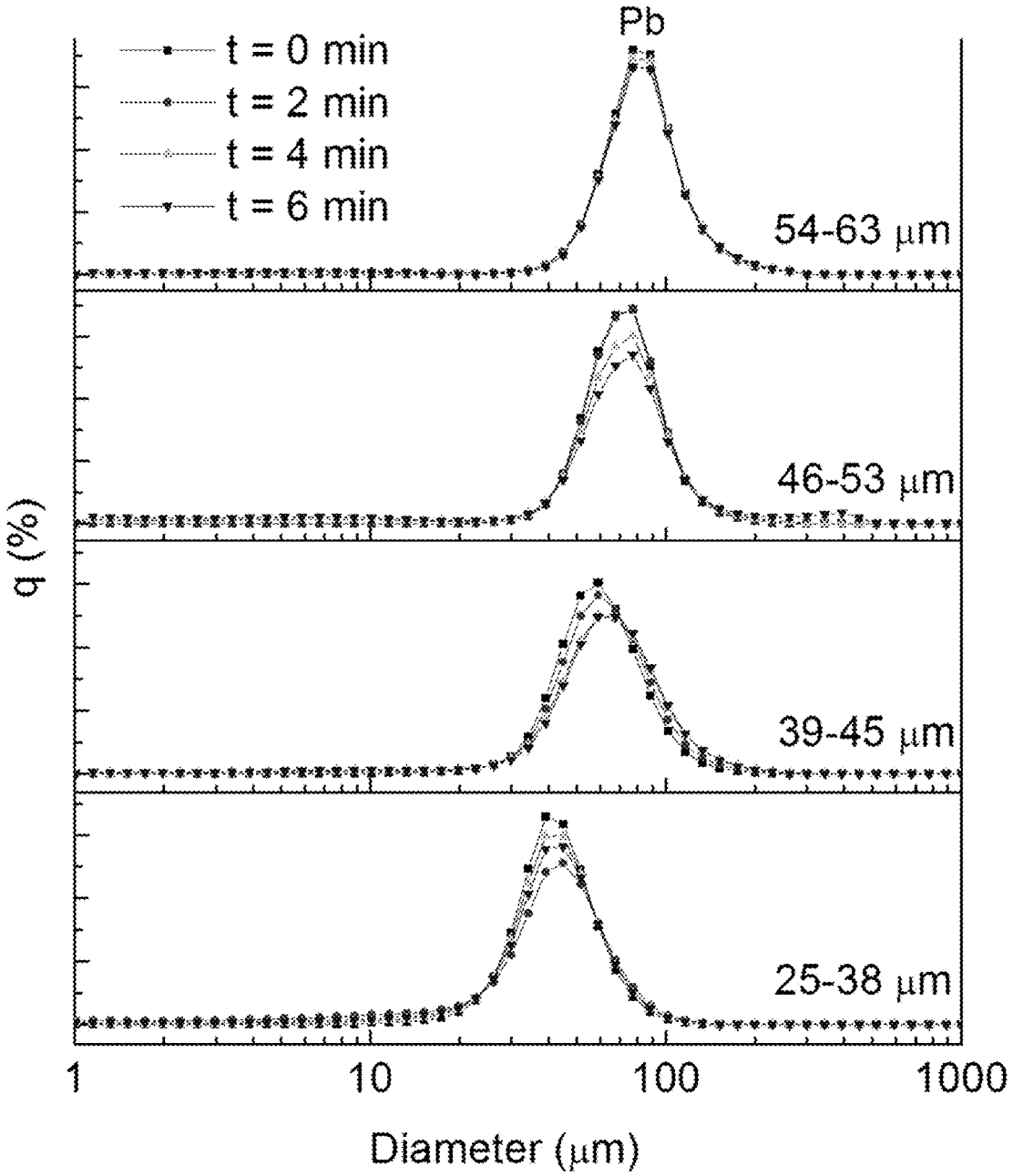
FIGS. 10 and 11 show change in the average particle size of four Pb lead powder with different size range in 2 and 30 minute increments respectively. Data was obtained from the Pb peak position in FIG. 7.
Figure 11:
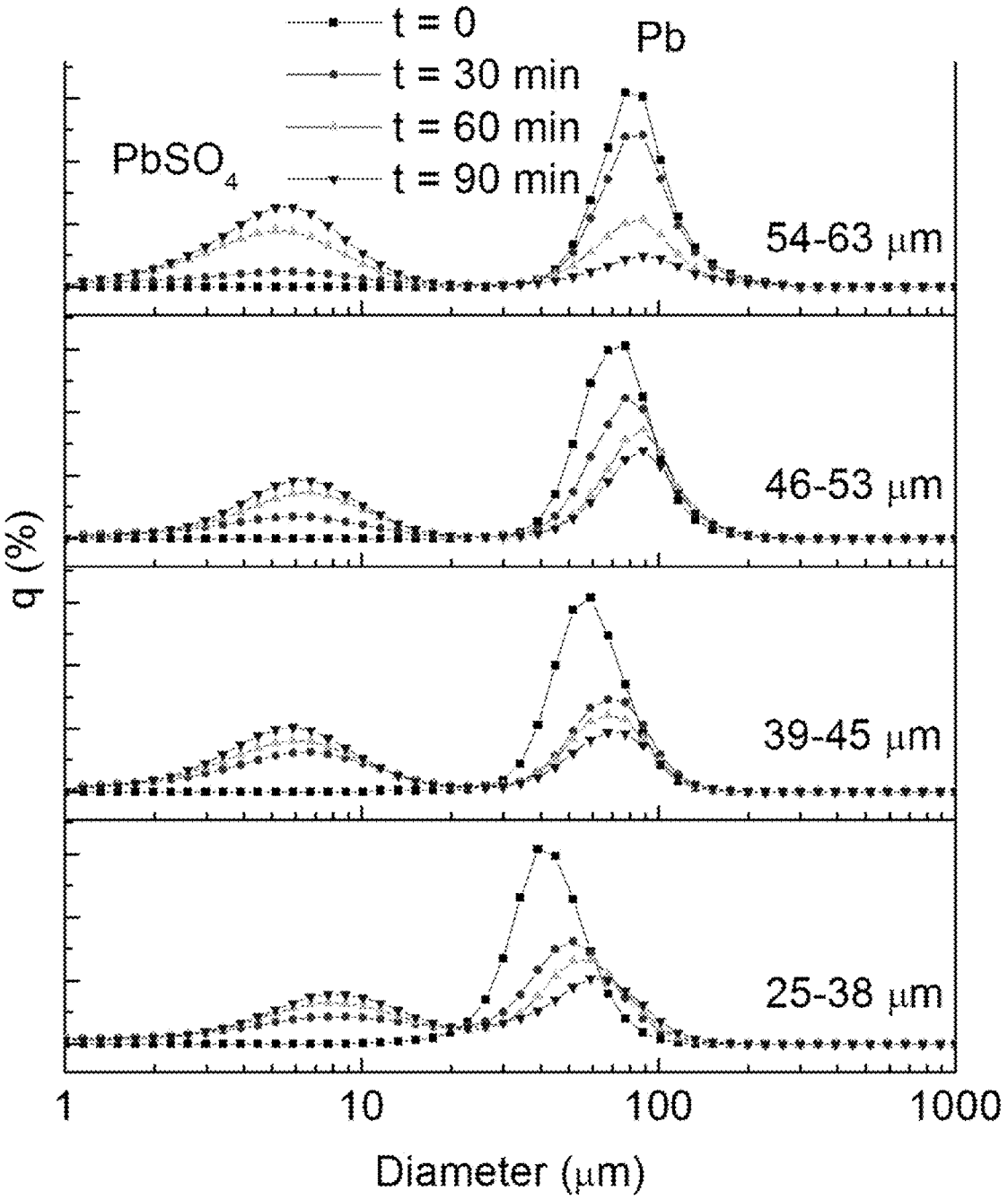

Each powder range was measured under the same conditions. A small stir bar provided turbulent agitation in an attempt to keep particles suspended during dynamic light scattering measurements. FIGS. 10 and 11 show the changes in the size distribution of the four powders during agitation in a 4M sulfuric acid solution.

For the first 10 min, the particle size distributions were recorded in 2 min intervals, as shown in FIG. 10. It can be seen that with increasing time, the average particle size shifts towards larger values, indicating the agglomeration and growth of Pb particles in the suspension. Since the analysis software provides a normalized number percent rather than the absolute number of particles of size q, statements on changes in the number of particles of a particular size cannot be made. For longer measurement times (FIG. 11), the size distribution continues to shift to larger particle sizes, while a second peak begins to form in the size range 2-20 μm. The observation of this peak coincided with the appearance of a white precipitate suspended in the solution, indicating the formation of $PbSO_4$, as confirmed by XRD measurements.

Figure 12:
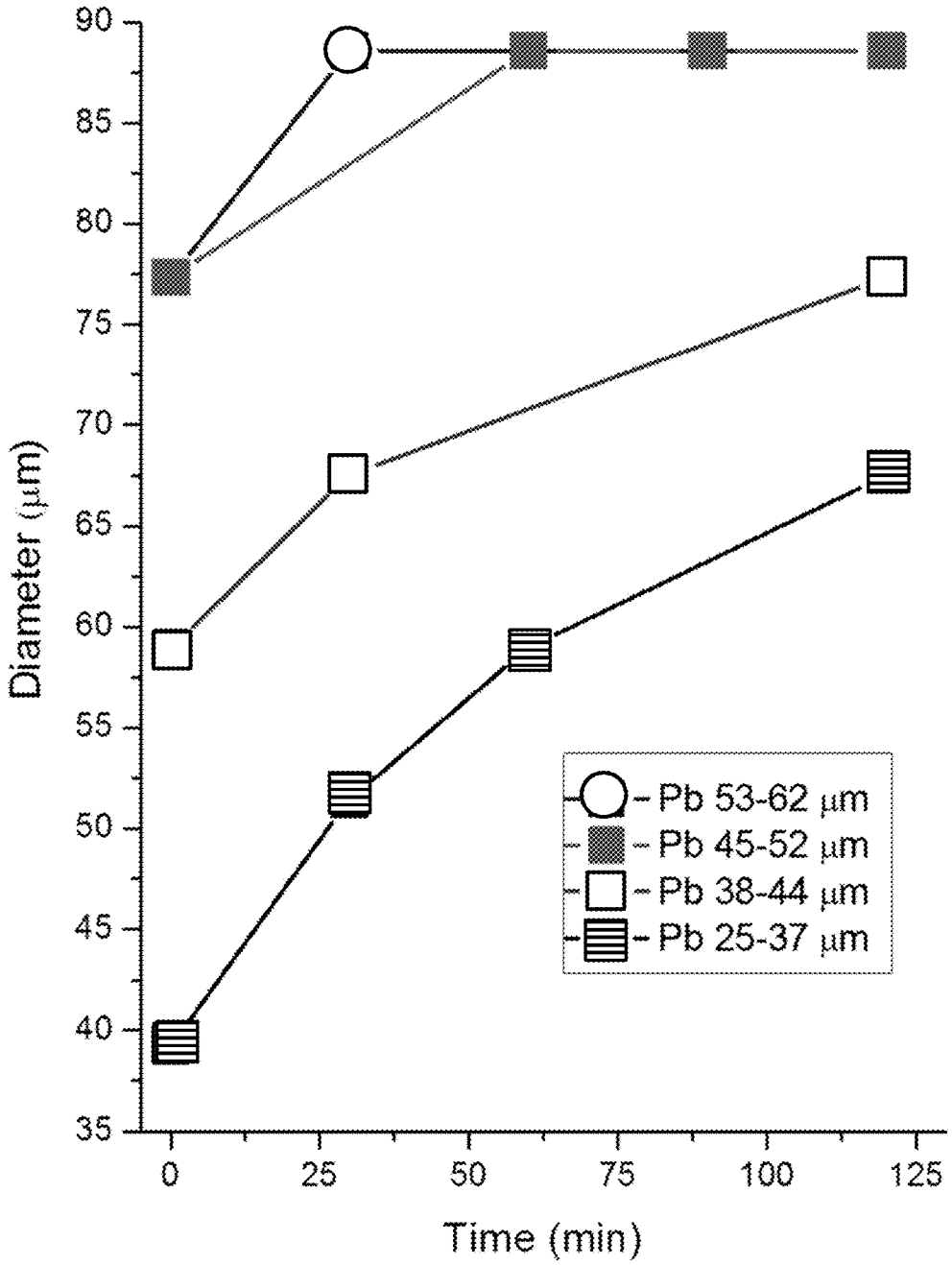
FIG. 12 shows particle size distribution plots of Pb particles exposed to 4M sulfuric acid solution as a function of time, based on the data from FIGS. 10 and 11.

FIG. 12 provides a more rigorous analysis of the recorded size-distribution curves which highlights the size dependence of the agglomeration process. Larger particles (53-62 μm) tend to form larger agglomerates as compared to smaller particles (25-37 μm), resulting in a more rapid shift in the size distribution. The bigger agglomerates settle out of the solution faster than the smaller agglomerates and are not further included in the measurement. This was confirmed by visual observations as with increasing time, the number of particles precipitating to the bottom of the vial increased.

Figure 13:
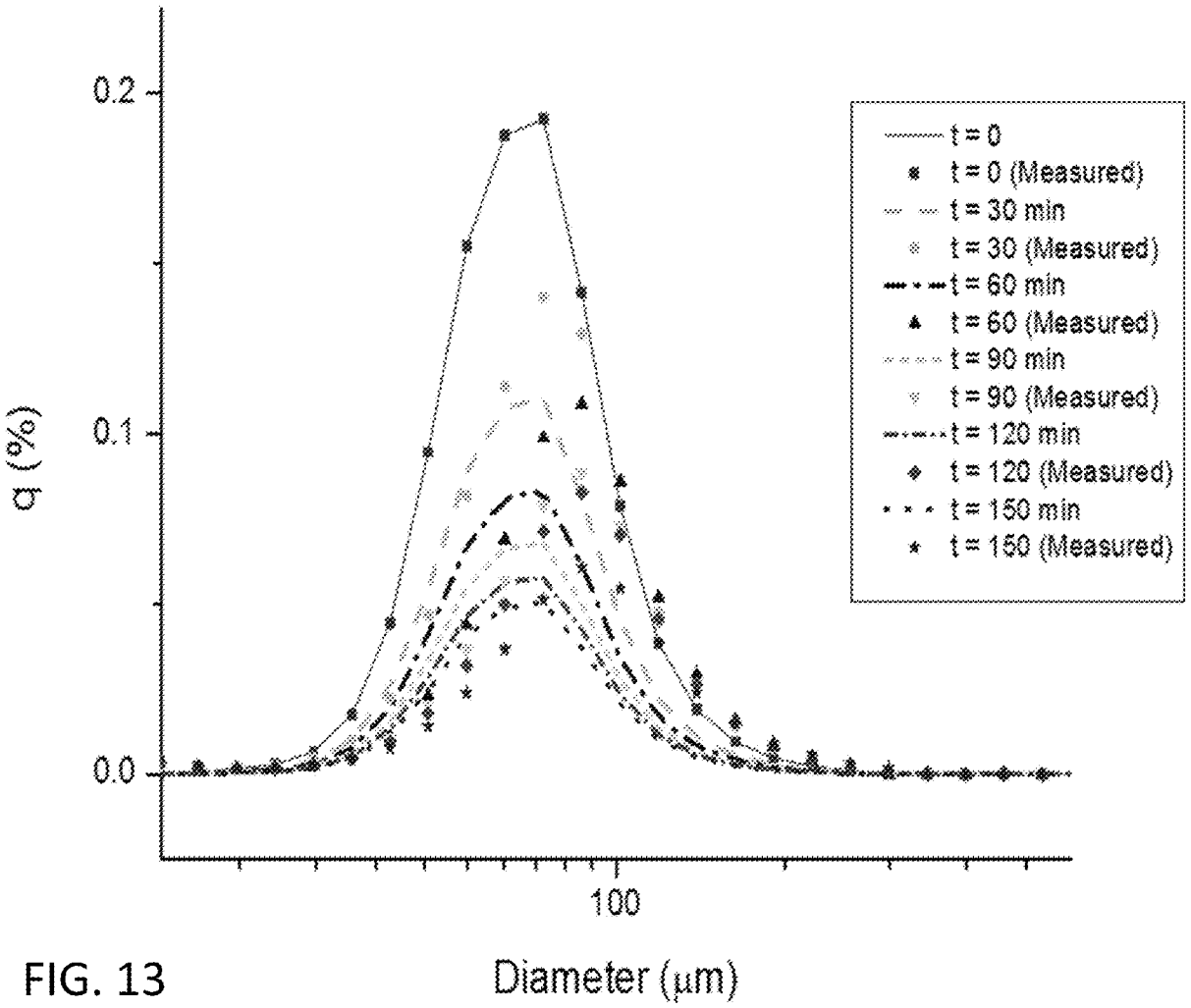
FIG. 13 is a plot comparing analytical model predictions to experimentally measured particle size distributions of Pb particles exposed to 4M sulfuric acid solution as a function of time.

The experimental results were compared with an analytical model from Equations 7 and 8. Sherwood's mass transport correlation of spherical particles in an agitated tank was used to model the agglomeration of the Pb particles:

$$\frac{k(i,j)}{\mu_m k_B T(d_i + d_j)} = \beta\left(\frac{\nu}{\mu_m k_B T}\right)^{1/3}\left(\frac{\varepsilon d_i^4}{\nu^3}\right)^{1/3} N_{ps}^{C4} \tag{17}$$

where $\epsilon$ is the rate of energy dissipation per unit mass of fluid and $\nu$ is the kinematic viscosity of the fluid. For the model, the Pb particles were assumed to be inelastic and spherical with $\beta=1$ and $C_4=1$, and the first particle size distribution measurement was used as the initial conditions. The results are shown in FIG. 13.

The fairly close agreement between the model and the experimentally determined size distributions suggests that the model gives a reasonable approximation of the changes in particle size over time and could be used for analyzing and controlling agglomeration processes in CDPC-based manufacturing.

vi) Agglomerate Analysis by SEM and EDS

Figure 14A:
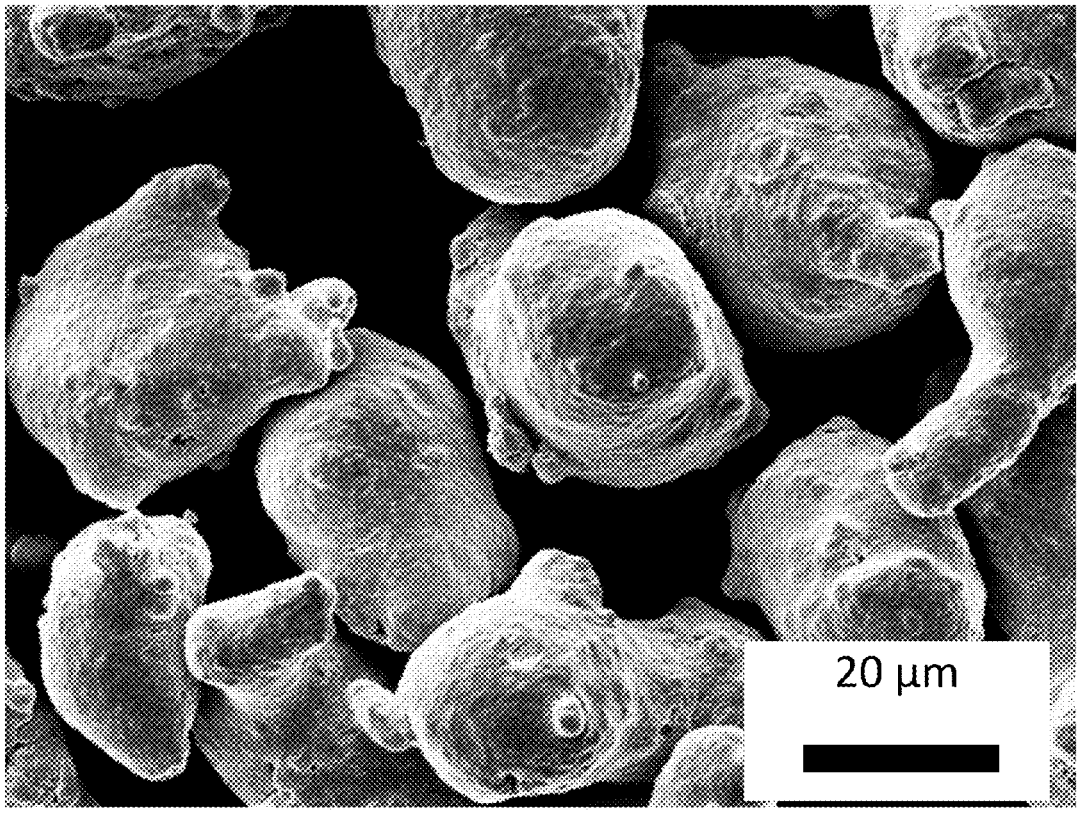
FIG. 14 shows Scanning Electron Microscope (SEM) images of (a) sieved 25-38 micrometer Pb powder, and (b-c) a 100 mg sample of the powder after exposure to 4M $H_2SO_4$ for 12 h with agitation.
Figure 14B:
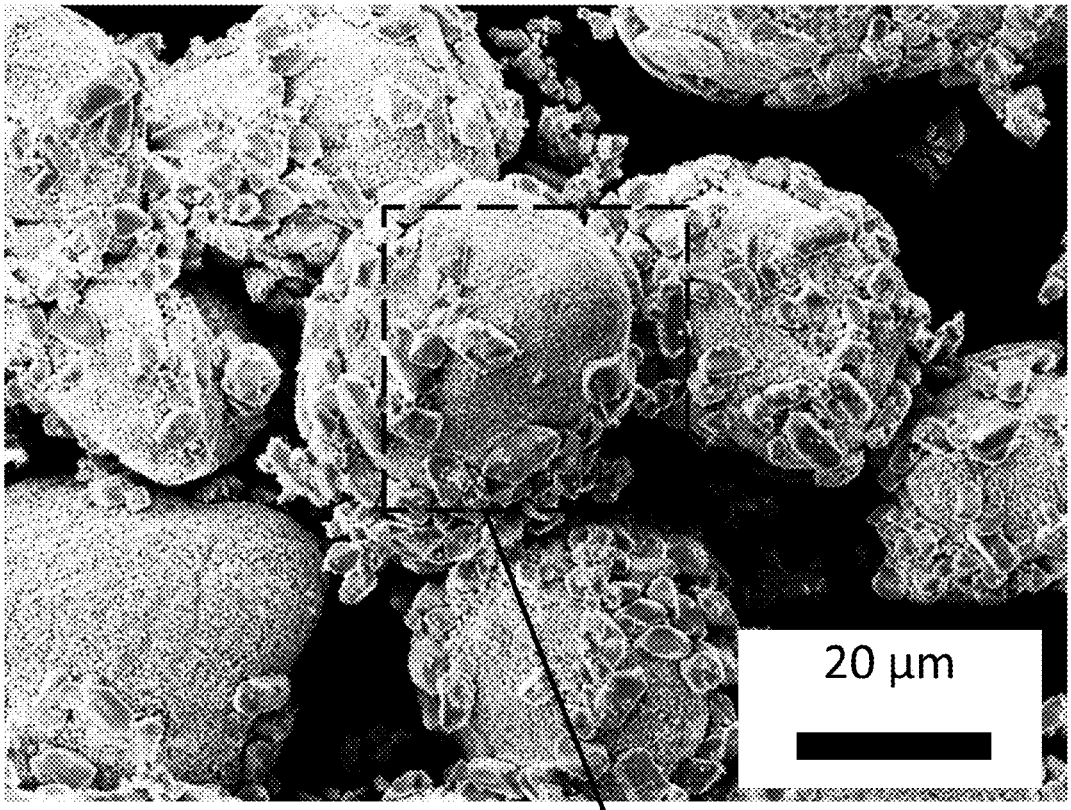
Figure 14C:
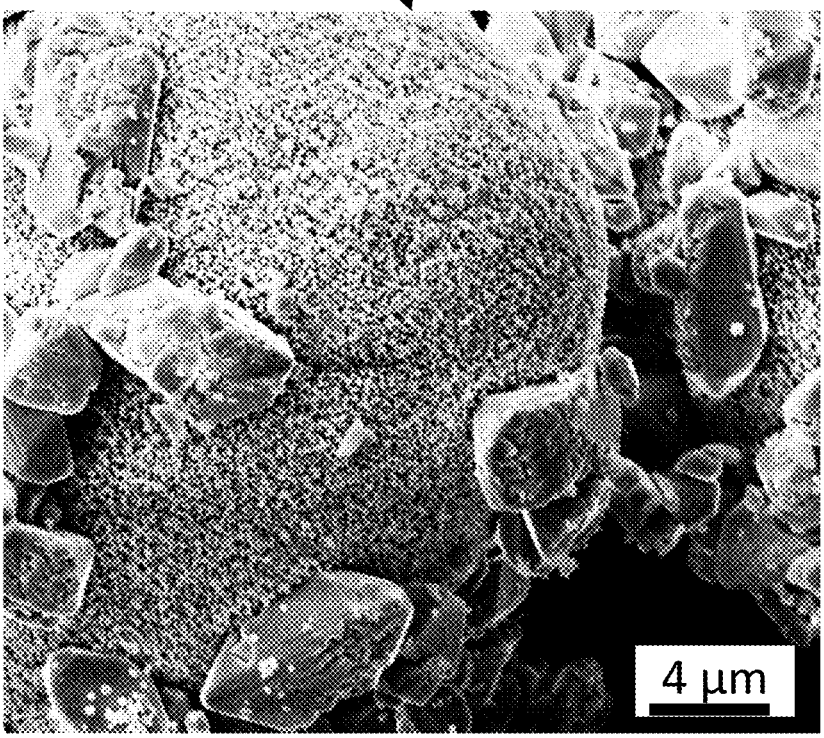

FIG. 14 shows scanning electron microscopy (SEM) micrographs of the precipitant collected from the 25-38-μm powder sample, recorded before (a) and after (b) exposure to 4M sulfuric acid for 12 h. It should be noted that as part of the sample preparation for SEM imaging, powders were rinsed with deionized water, resulting in the removal of most of the water-soluble $PbSO_4$. A closer inspection of the particles at higher magnification revealed the formation of small crystals on the surface of the Pb powder particles. The surface of the Pb powder particles appears corroded, indicating the dissolution of Pb in accordance with Equation 9. The smaller crystals that were observed on the surface of larger Pb particles were analyzed by energy dispersive X-ray spectroscopy (EDS) and found to consist primarily of metallic Pb with traces of $PbSO_4$ present at the surface. This suggests that the particle agglomeration is accompanied by additional processes, one of which appears to be the dissolution and re-deposition of Pb.

To identify the internal structure and composition of agglomerated Pb particles, a focused ion beam (FIB) for SEM/EDS analysis was used to expose a pristine cross-sectional sample area of an approximately 1 cm aggregate formed by exposing micrometer-sized Pb powder to a 4M $H_2SO_4$ solution with mechanical stirring for 130 hrs. A high magnification micrograph of the exposed FIB cut shows areas of densely packed Pb particles as well as pores filled with smaller granulates. An EDS scan across one of the pores revealed the elemental composition of the Pb particles and granulates.

From the EDS scan, the elements Pb, S, and O were detected with Pb being the majority. On average, Pb accounted for 80 atomic %, while S and O were measured as 15 and 5 at %, respectively. The increase in the S and O peaks (up to ≈30 at % and ~10 at %, respectively) with a corresponding decrease in the Pb peak (~60 at %) at distances of ~3 and ~6 μm of the EDS line scan indicates the presence of $PbSO_4$ (a Pb:$PbSO_4$ ratio of 1:1 based on at %).

Three different types of growth are apparently present. The first is the re-deposition of Pb on a $PbSO_4$ particle shown at points 3 and 6 on the EDS line scan. The second type of growth is the re-deposition of Pb between Pb particles, which appears to be the prevalent process according to EDS data. Finally, the last type of growth is the formation of $PbSO_4$ on a Pb particle. The SEM shows some porosity in the aggregate where smaller particles appear to be encapsulated between bigger particles that are connected.

Figure 15:
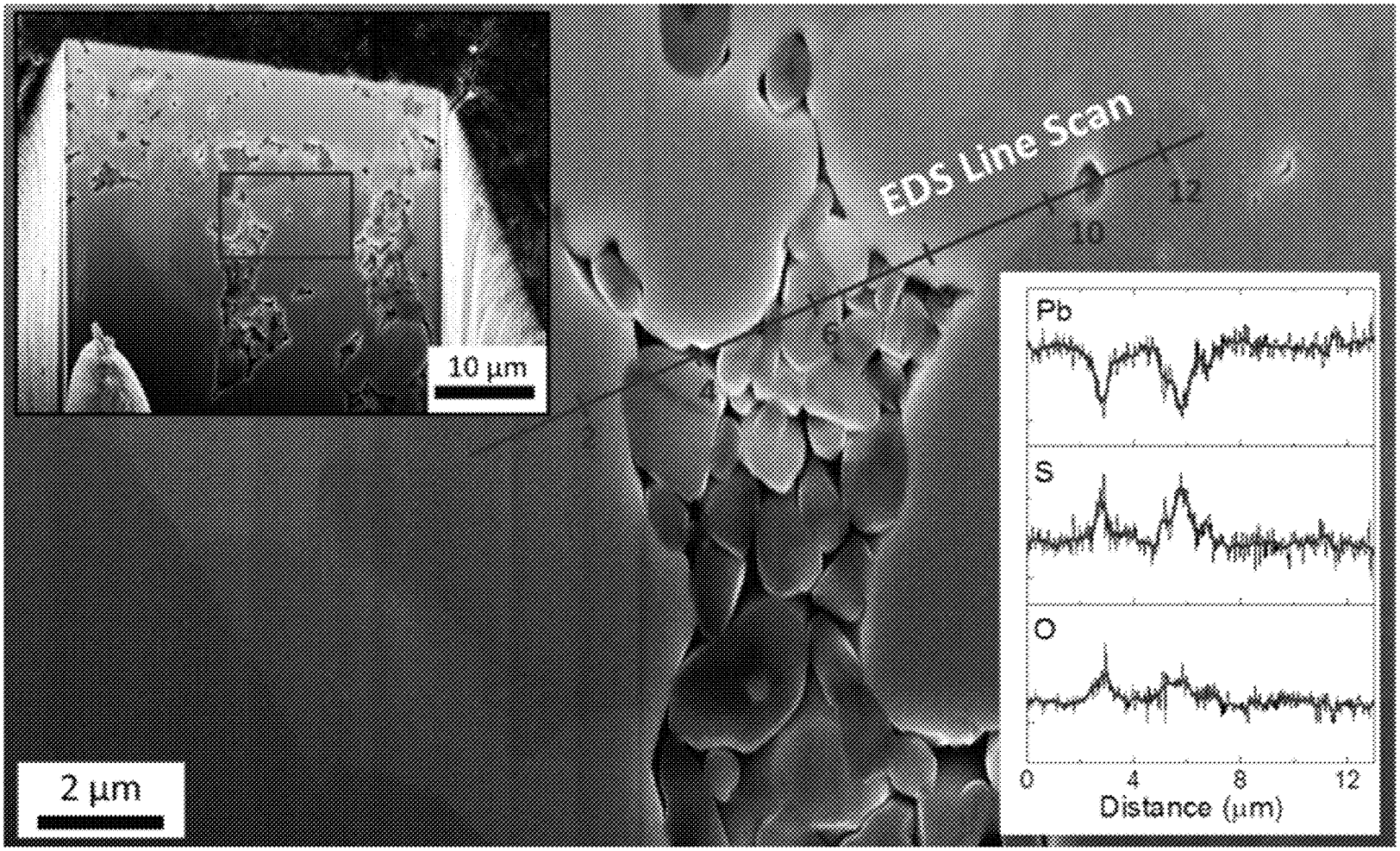
FIG. 15 shows a cross section of a centimeter-sized Pb aggregate created by a focused ion beam (FIB) cut in a scanning electron microscope and the determination of Pb and $PbSO_4$ sites using an energy dispersive X-ray spectroscopy (EDS) line scan.

As suggested above, diffusion limited aggregation (DLA) results from individual particles diffusing into larger agglomerates. Cluster-cluster aggregation (CCA) occurs when like-sized agglomerate clusters coagulate. Both cases were observed in FIG. 15, with DLA forming the majority of the aggregate. The resulting fractal dimension could not be measured due to the complexity of the agglomerate and the observed re-deposition of material. However, an approximation can be made by determining volume (displacement method in high viscosity silicon oil) and mass of the aggregate. The density of the consolidated sample was measured as ~7.0 g/cm$^3$, which corresponds to ~62% of the theoretical density (11.34 g/cm$^3$). The resulting factual dimension was calculated to be 2.3, which agrees with observations and explains the 62% Pb densification difference. The lower densification is a result of inaccessible pores formed during DLA and formation of $PbSO_4$, which has a density of 6.29 g/cm$^3$, during the re-deposition process as indicated in FIG. 15.

vii) Influence of Oxygen Content on Lead Agglomeration

Figure 16:
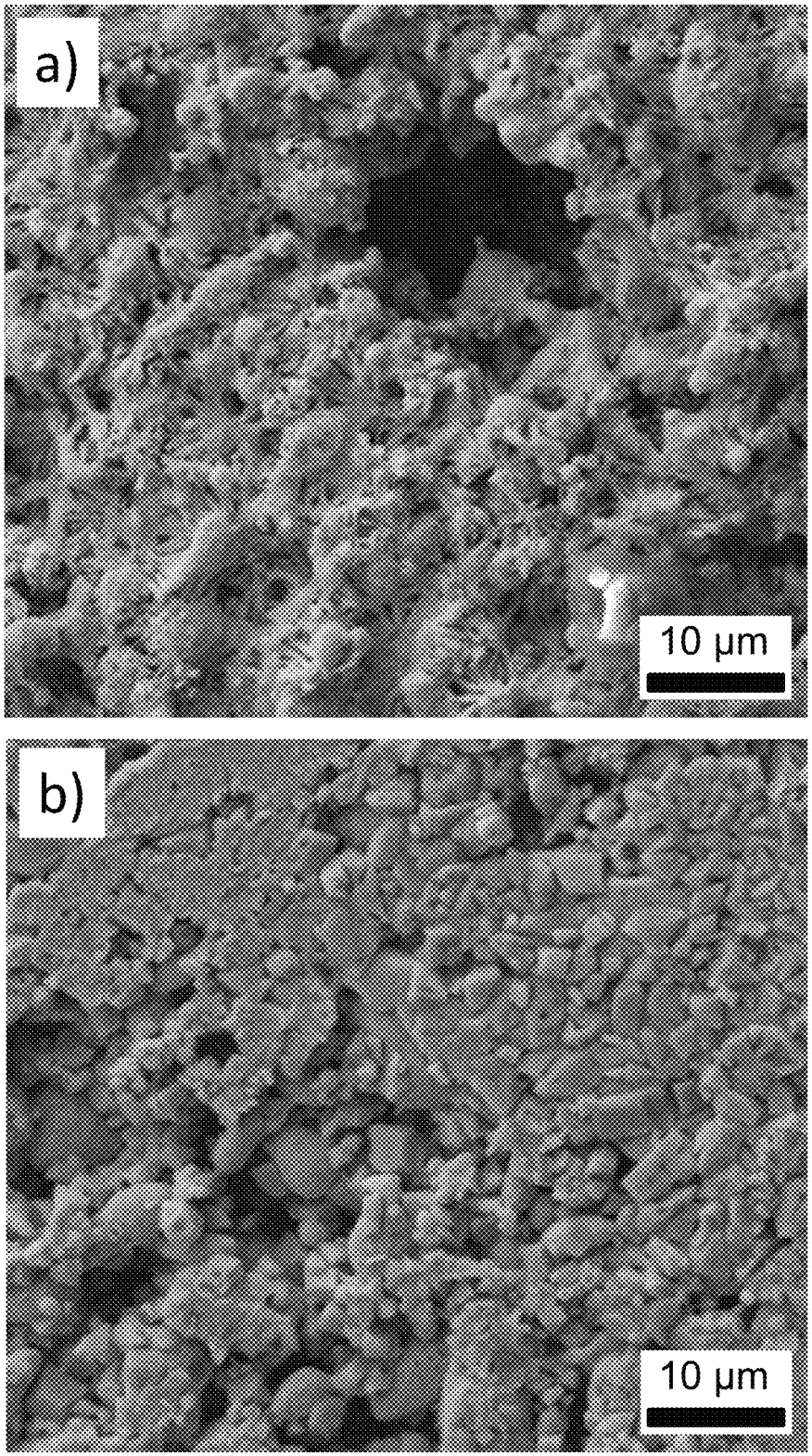
FIG. 16 shows SEM images of Pb aggregates formed with and without oxygen present: a) Pb aggregate created from agglomerated micrometer sized Pb particles exposed to a 4M $H_2SO_4$ solution after being mechanically stirred for 48 hours and exposed to the atmosphere; b) Pb aggregate created from agglomerated micrometer sized Pb particles exposed to a 4M $H_2SO_4$ oxygen-stripped solution after being mechanically stirred for 48 hours.

Pb powder (325 mesh) was exposed to 4M sulfuric acid with stir bar agitation for 48 hrs. In one experiment, the solution was exposed to the atmosphere. The Pb powder agglomerated into large aggregates, and dendrite crystal growth was observed on the exposed surfaces of the powder. In another experiment, the sulfuric acid was stripped of oxygen using a vacuum and replaced with stream of argon gas with a measured oxygen content of less than 10 ppm. The Pb powder agglomerated as expected but faceted crystal growth was observed. The faceted crystal growth allows for a more compact and dense aggregate. FIG. 16 shows SEM micrographs providing a comparison of Pb aggregates formed with and without oxygen.

Example 2

Tin Powder Solidification in Acidic and Alkaline Solutions

FIG. 4 shows the potential-pH equilibrium diagram (Pourbaix Diagram) for tin-water at 25° C. Suitable operating regions 60, 62 for powder agglomeration are highlighted. Similar to lead, there are two active agglomeration regions at low and high levels, respectively, which are summarized in TABLE 2.

TABLE 2

Operating regions for tin aggregation in an aqueous solution at 25° C.

| Material | Symbol | pH | Voltage |
|---|---|---|---|
| Tin | Sn | <1 and >13 | >−0.38 V Acidic<br>>−1.3 V Alkaline |

i) Tin Powder Agglomeration in Low pH Regime

Tin powder (325 mesh size) was placed in a 4M solution of sulfuric acid. After less than five minutes, the particles agglomerated into large aggregates.

Figure 17:
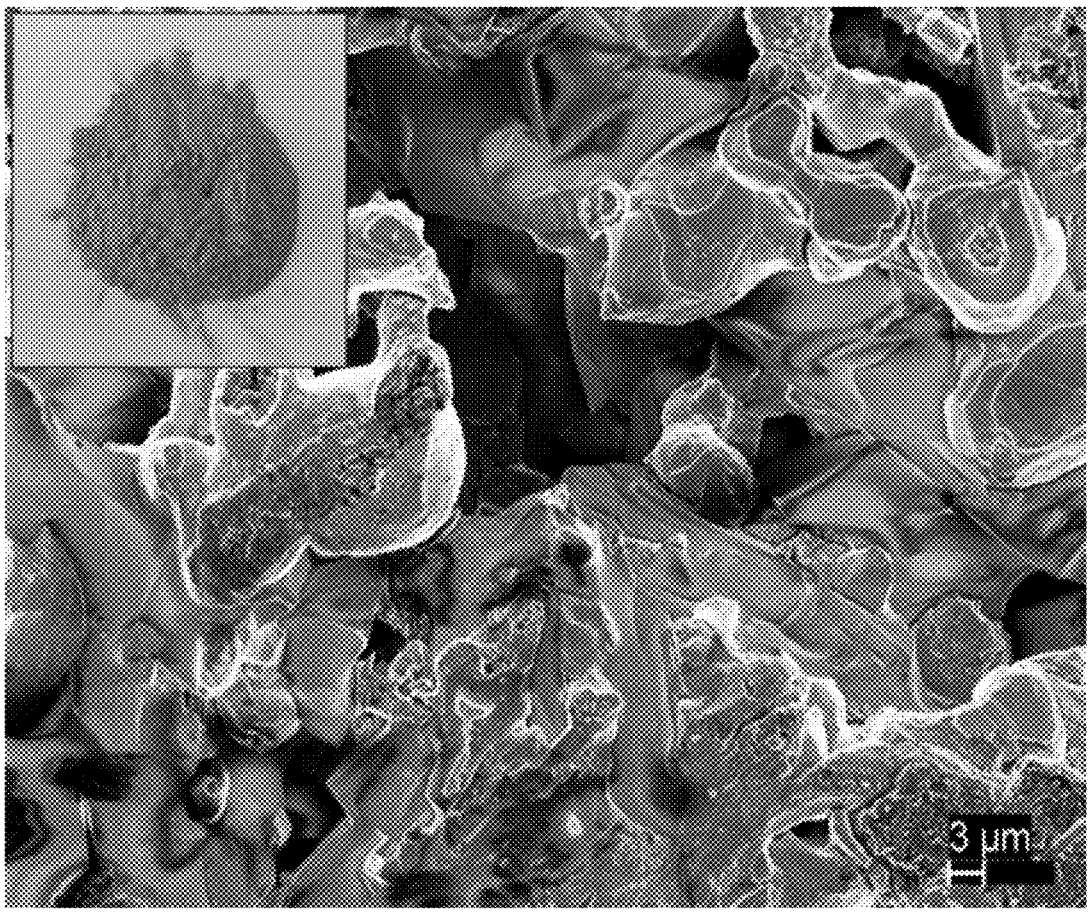
FIG. 17 shows an SEM image of a Sn sample exposed to 2M $H_2SO_4$ made from as-received Sn powder shown in the upper left of the image.

Similar results were found for a tin powder sample exposed to 2M $H_2SO_4$ FIG. 17 shows an SEM image of the Sn sample exposed to 2M $H_2SO_4$ made from as received Sn powder shown in the upper left.

ii) Tin Powder Agglomeration in High pH Regime

Tin powder (325 mesh size) was placed in a 10M KOH solution. After less than five minutes, the powder particles agglomerated and formed a large aggregate.

Both acid and alkali-formed agglomerates tended to resist being broken up by additional agitation making them strong candidates for the CDPC additive manufacturing process. The re-deposition process occurred faster than either Pb or Zn and formed larger bulk crystal growth between the particles.

Example 3

Zinc Powder Solidification in Alkaline Solutions

Due to a large surface potential in strong acids, (Zn) tends not to be a good candidate in the low pH regime. Zn was, however, observed to form millimeter sized spherical aggregates in strong bases after 20 h of agitation. In particular, millimeter sized Zn aggregates and Zn—$C_{nt}$ (carbon nanotube) composite aggregates were created from micrometer sized powder exposed to a 2M KOH solution after being mechanically stirred for 20 h. The Zn—$C_{nt}$ composite powder was made by ball milling Zn and $C_{nt}$ powder together at a 10:1 ball to powder weight ratio. A weight ratio of Zn:$C_{nt}$ was 20:1.5. The Zn powder was added to 1.5 g of nanotubes in 5 g increments up to a total of 20 g over time (1 day between increments).

Unlike Pb, the Zn aggregate growth observed in these experiments was limited to the millimeter size range and more spherical in morphology. This could be a result of agglomeration (stage 1) hindrances due to elastic properties of the particles or suppression (stage 5) due to differences in the equilibrium chemical kinetics. With additional powder engineering processes, the manufacture of composite structures is feasible as demonstrated using Zn and carbon nanotubes ($C_{nt}$) after high energy ball milling. Without ball milling, applying the CDPC consolidation process using Zn and $C_{nt}$ resulted in a shear thinning viscous slurry of ≈100 nm long semi-hexagonal Zn rods 30-40 nm in diameter. Instead of re-deposition (stage 4) occurring between particles, the Zn apparently used the $C_{nt}$ as nucleation sites for re-deposition. This result shows promise for applying the CDPC consolidation process for manufacturing nanostructures and energy storage applications, which includes high surface area materials for conventional and semi-solid flow batteries.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A powder consolidation method, comprising:

contacting a metal-containing powder comprising metal particles with an acidic or basic liquid at a pH and in a potential range at which dissolution of metal from the particles and reduction of soluble metal-containing ions to reduced metal on surfaces of the particles occur such that the metal particles are bound together by the reduced metal to form a body.

2. The method of claim 1, wherein the method further includes agitating the combined liquid and metal-containing powder.

3. The method of claim 1, wherein the body has a size which is at least 10 times the average size of the metal particles in the metal-containing powder.

4. The method of claim 1, wherein the body is at least 0.5 cm in a longest dimension.

5. The method of claim 1, wherein the body comprises a plurality of bodies, which are on average, at least 0.1 cm in a longest dimension.

6. The method of claim 1, wherein the average size of the metal particles in the metal-containing powder is less than 100 μm.

7. The method of claim 1, wherein the contacting is performed in a mold and the body is shaped by the mold.

8. The method of claim 1, wherein the contacting is performed at a temperature of less than 100° C.

9. The method of claim 1, wherein during the contacting, an oxygen concentration of the liquid is less than 50% of saturation.

10. The method of claim 1, further prior to the contacting, comprising determining the pH and potential from a potential-pH equilibrium diagram.

11. The method of claim 1, wherein the metal particles comprise at least one of lead, tin, copper, cobalt, molybdenum, bismuth, silicon, indium, thallium, tellurium, zinc, and alloys and mixtures thereof.

12. The method of claim 1, wherein the metal particles comprise lead and the pH of the liquid is less than 6 and the potential is 0.1 V to −0.4 V or the pH is greater than 14.4 and the potential is 0.1 V to −0.7 V.

13. The method of claim 1, wherein the metal-containing powder and formed body are predominantly metal.

14. The method of claim 1, wherein the metal-containing powder further comprises carbon nanotubes.

15. The method of claim 14, wherein the metal-containing powder and carbon nanotubes are ground together prior to combining the metal-containing powder with the liquid.

16. The method of claim 1, wherein the contacting further comprises contacting the metal-containing powder with a potential modifying agent selected from hydrogen peroxide, vanadium oxide, and surfactants.

17. The method of claim 1, further comprising repeating the contacting to form the body from a plurality of layers.

18. The method of claim 1, further comprising sintering the larger body to increase a density of the body.

19. The method of claim 1, further comprising forming a battery in which the body serves as an electrode.

20. A powder consolidation apparatus, comprising:

a mold including a cavity which defines the shape of a shaped body;

a source of a metal-containing powder which supplies metal powder to the cavity, the metal-containing powder comprising metal particles;

a source of acidic or basic aqueous liquid fluidly connected with the cavity which provides acidic or basic liquid in the cavity, such that a pH and in a potential range during contact of the particles with the aqueous liquid allow dissolution of metal from the particles and reduction of soluble metal-containing ions to metal on surfaces of the particles to occur such that the metal particles agglomerate to form a shaped body in the mold cavity; and optionally, at least one of:

a controller for maintaining a temperature of the liquid in the cavity at less than 100° C.; and an agitator for agitating the metal particles in the cavity.

* * * * *